US010376073B2

(12) United States Patent
Grubb

(10) Patent No.: US 10,376,073 B2
(45) **Date of Patent: *Aug. 13, 2019**

(54) ROLLING FOLDOUT CABINET BED

(71) Applicant: Jeffrey A. Grubb, Yorba Linda, CA (US)

(72) Inventor: Jeffrey A. Grubb, Yorba Linda, CA (US)

( * ) Notice: Subject to any disclaimer, the term of this patent is extended or adjusted under 35 U.S.C. 154(b) by 122 days.

This patent is subject to a terminal disclaimer.

(21) Appl. No.: 14/839,602

(22) Filed: Aug. 28, 2015

(65) Prior Publication Data

US 2016/0058196 A1 Mar. 3, 2016

Related U.S. Application Data

(60) Provisional application No. 62/043,222, filed on Aug. 28, 2014.

(51) Int. Cl.

| | |
|---|---|
| ***A47C 17/52*** | (2006.01) |
| ***A47C 17/60*** | (2006.01) |
| ***A47C 17/54*** | (2006.01) |

(52) U.S. Cl.

CPC ..... *A47C 17/54* (2013.01); *A47C 17/52* (2013.01); *A47C 17/60* (2013.01)

(58) Field of Classification Search

CPC ..... A47C 17/38; A47C 17/42; A47C 17/46; A47C 17/50; A47C 17/52; A47C 17/54; A47C 17/56; A47C 17/60; A47B 46/005; A47B 43/00

See application file for complete search history.

(56) References Cited

U.S. PATENT DOCUMENTS

| | | | | | |
|---|---|---|---|---|---|
| 67,816 | A * | 8/1867 | Stock | A47C 19/122 | 5/152 |
| 83,936 | A * | 11/1868 | Crosby | A47C 19/122 | 5/152 |
| 107,881 | A * | 10/1870 | Crosby | A47C 19/122 | 5/152 |
| 119,079 | A * | 9/1871 | Crosby | A47C 19/122 | 403/4 |
| 157,719 | A * | 12/1874 | Iverson | A47C 19/122 | 5/152 |
| 179,013 | A * | 6/1876 | Green | A47C 19/122 | 5/152 |

(Continued)

OTHER PUBLICATIONS www.google.com/products?hl=en&exp . . . ; Foldable Bed Google Search; Sep. 23, 2010.

(Continued)

*Primary Examiner* — Nicholas F Polito
*Assistant Examiner* — Rahib T Zaman
(74) *Attorney, Agent, or Firm* — Fish IP Law, LLP

(57) ABSTRACT

A foldout cabinet bed has two faces that fold out from a vertical position to a horizontal position, thereby creating a surface that can be used for sleeping. Each face has two side rails for enclosing an area for placing a mattress. The rails are dimensionally asymmetrical such that one of the faces has a smaller rail height/depth than the adjacent rail on the other face. The shorter rail height is smaller than the thickness of the mattress, thus allowing a user to comfortably sit on the edge of the mattress. The taller rail height is larger than the thickness of the mattress and provides a headboard.

21 Claims, 17 Drawing Sheets

(56) References Cited

U.S. PATENT DOCUMENTS

| | | | | | |
|---|---|---|---|---|---|
| 179,513 | A * | 7/1876 | Burr | A47C 17/40 | 5/152 |
| 192,621 | A | 7/1877 | Green | | |
| 201,282 | A | 3/1878 | Ogboen | | |
| 213,001 | A | 3/1879 | Stanton | | |
| 218,678 | A * | 8/1879 | Koskul | A47C 19/122 | 5/151 |
| 253,903 | A * | 2/1882 | Witmer | A47C 19/122 | 5/152 |
| 261,053 | A | 7/1882 | Shtjpe | | |
| 306,894 | A * | 10/1884 | Balke | A47C 17/62 | 5/4 |
| 309,111 | A * | 12/1884 | Slyke | A47C 19/122 | 5/152 |
| 310,343 | A * | 1/1885 | Warren | A47C 19/122 | 5/152 |
| 322,177 | A * | 7/1885 | Goode | A47C 19/122 | 5/152 |
| 431,825 | A * | 7/1890 | Sundback | A47C 19/122 | 5/152 |
| 1,353,536 | A * | 9/1920 | McGhee | A47C 17/60 | 5/150.1 |
| 1,409,770 | A * | 3/1922 | Piatkowski | A47C 17/60 | 5/2.1 |
| 2,356,321 | A * | 8/1944 | Irick | A47C 17/60 | 5/152 |
| 2,747,202 | A * | 5/1956 | Driver | A47C 17/46 | 5/136 |
| 3,161,892 | A * | 12/1964 | Ducrot | A47C 17/60 | 5/5 |
| 3,638,249 | A * | 2/1972 | Katsigarakis | A47C 17/60 | 5/159.1 |
| 3,877,086 | A * | 4/1975 | Bue | A47C 17/50 | 312/313 |
| 4,004,305 | A | 1/1977 | Rubin | | |
| 4,048,683 | A * | 9/1977 | Chen | A47C 19/122 | 5/174 |
| 4,985,945 | A | 1/1991 | Robinson | | |
| 4,985,951 | A | 1/1991 | Lacotte et al. | | |
| 5,170,519 | A | 12/1992 | Meade | | |
| 5,386,601 | A * | 2/1995 | Kohl | A47C 17/70 | 5/111 |
| 5,440,768 | A * | 8/1995 | Danin | A47C 17/62 | 5/3 |
| 5,446,932 | A | 9/1995 | Voorhis | | |
| 6,425,151 | B2 | 7/2002 | Barnett | | |
| 6,851,139 | B2 * | 2/2005 | Arason | A47C 19/122 | 5/152 |
| 7,013,506 | B2 | 3/2006 | Revels | | |
| 7,574,758 | B2 | 8/2009 | Arason et al. | | |
| 2008/0092290 | A1 | 4/2008 | Cabrera | | |
| 2008/0276872 | A1 | 11/2008 | Chern | | |
| 2012/0073045 | A1 * | 3/2012 | Grubb | A47C 17/52 | 5/136 |

OTHER PUBLICATIONS absolutecomfortonsale.com/roll-away- . . . ; Riviera Roll Away Bed; Sep. 23, 2010.

absolutecomfortonsale.com/rollaway-b . . . ; Our Top of the Line Rollaway Bed Models; Sep. 23, 2010.

absolutecomfortonsale.com/hide-a-be . . . ; The Ultimate Hide-a-Bed Guest Cabinet Bed; Sep. 23, 2010.

* cited by examiner

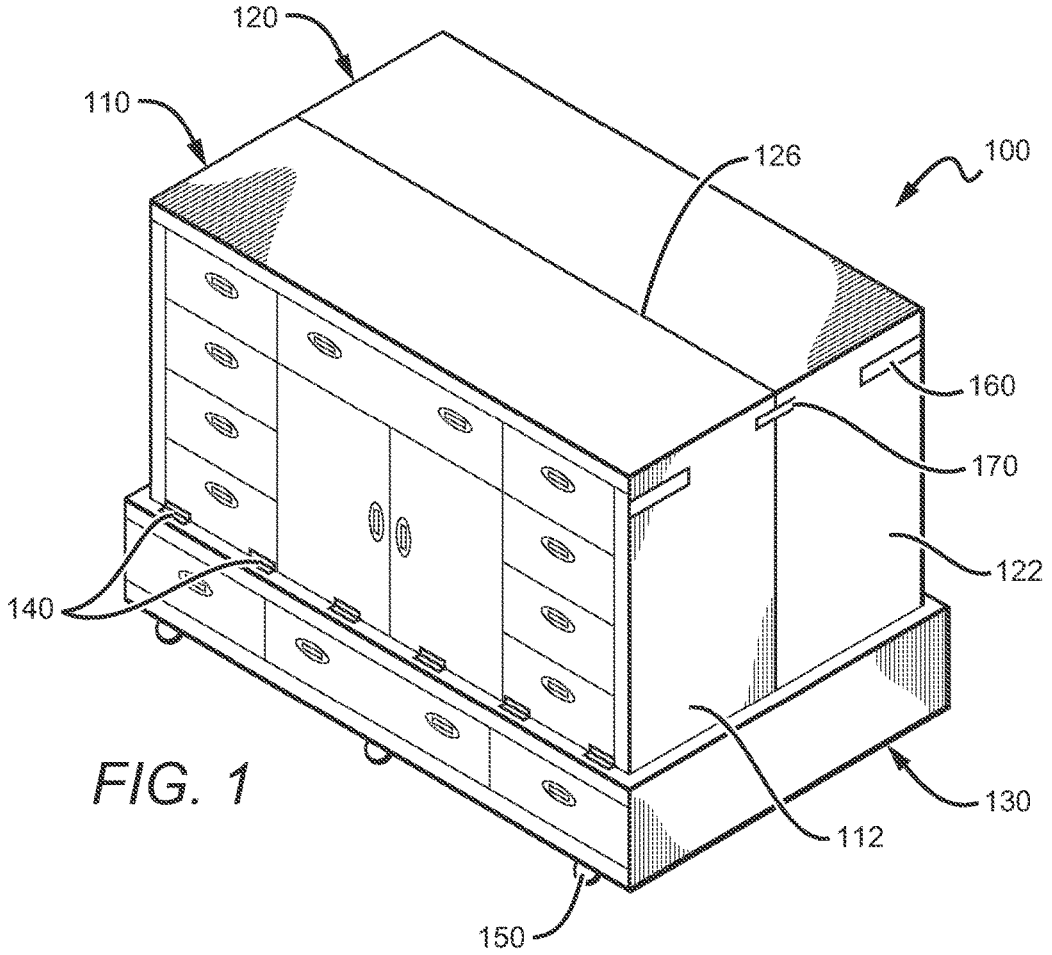
FIG. 1
FIG. 2
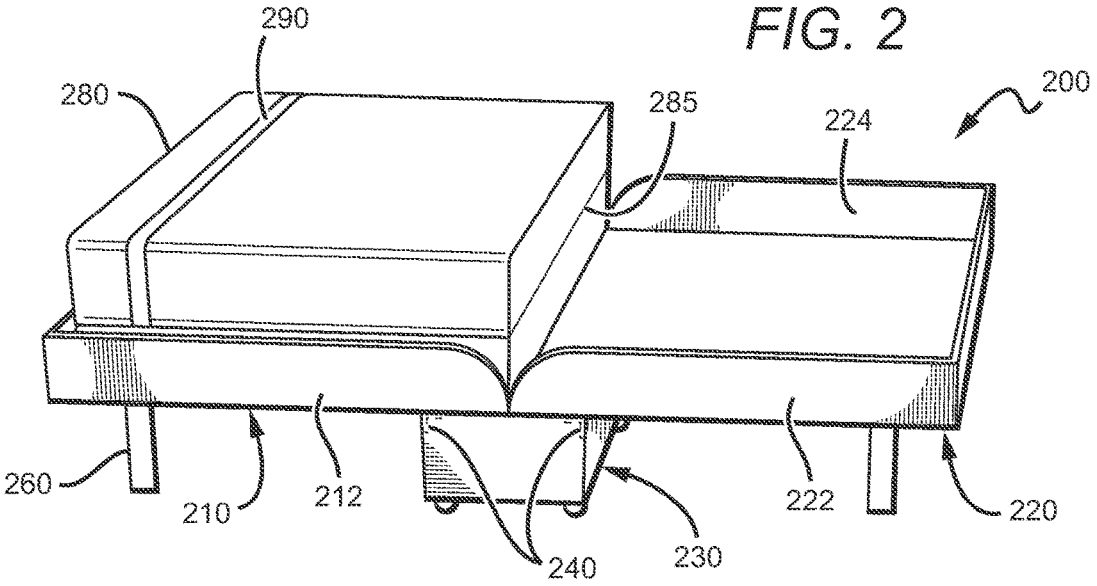

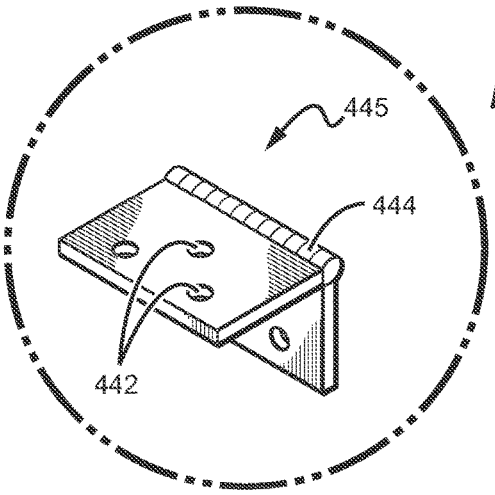
FIG. 4c
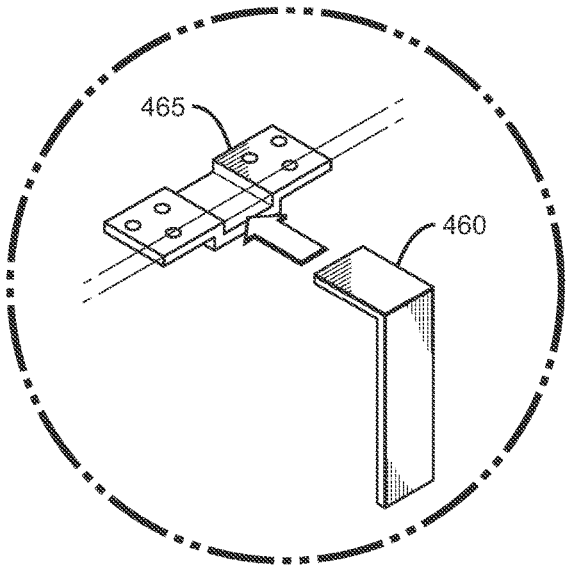
FIG. 5b
FIG. 5a
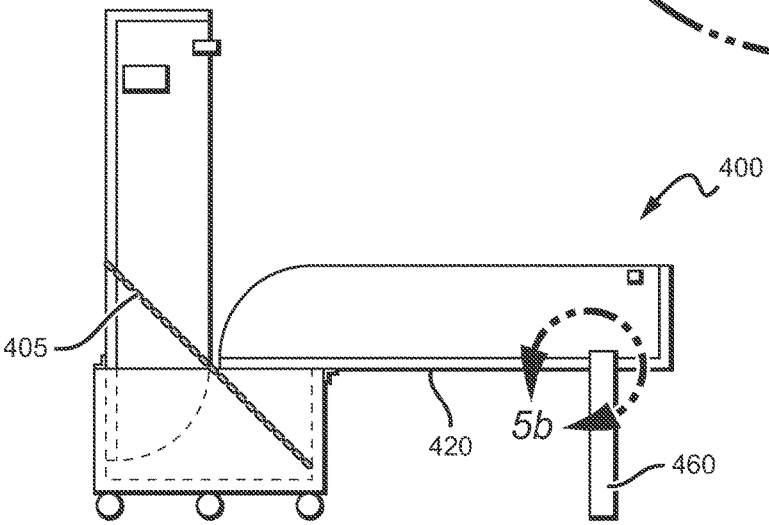

FIG. 15a
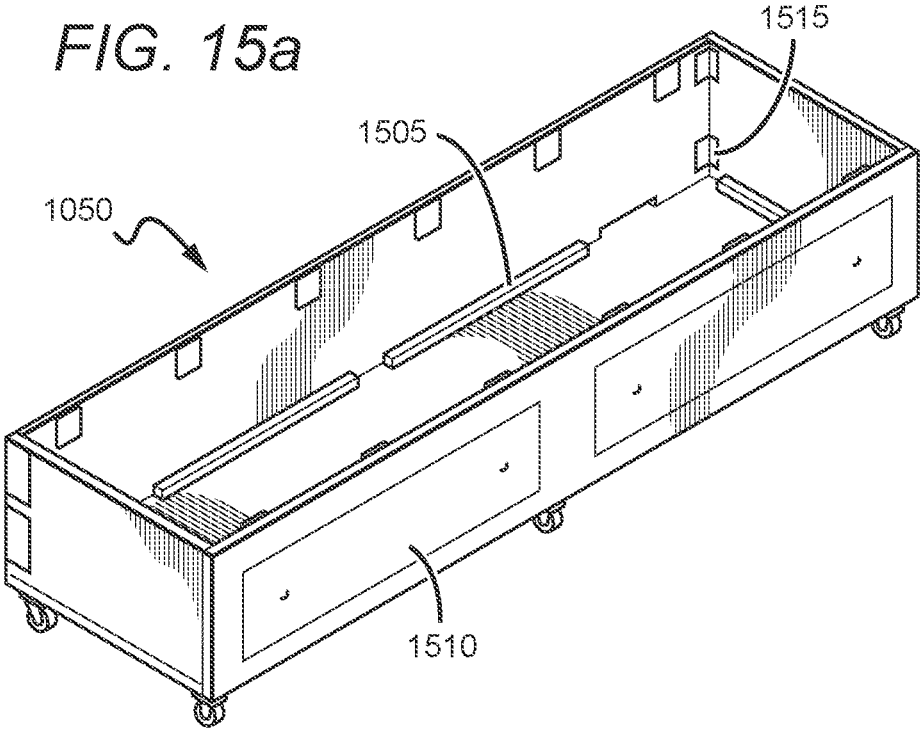
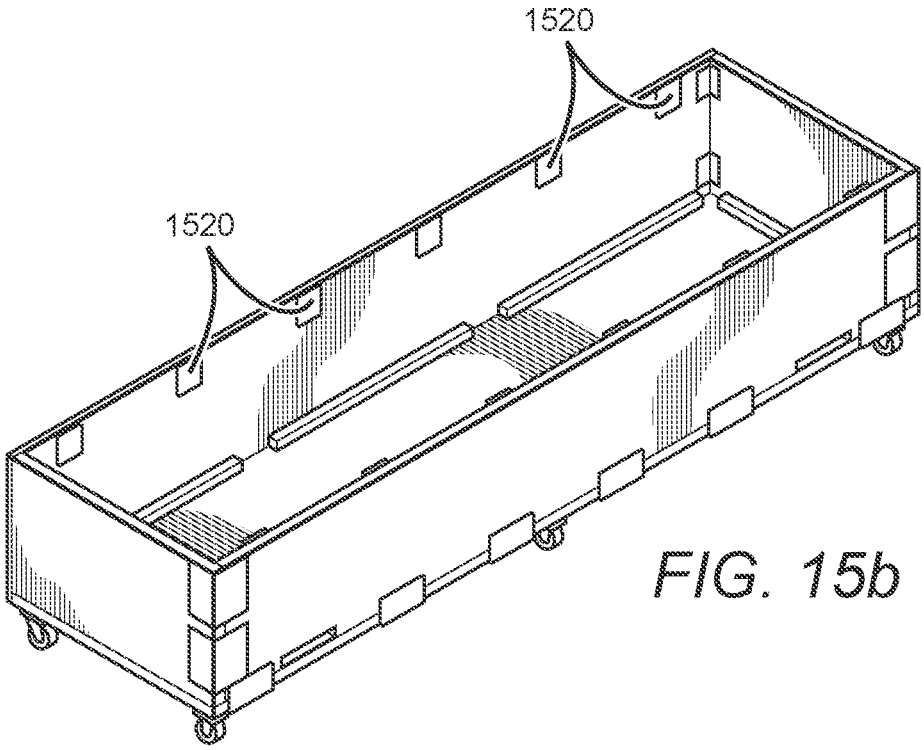
FIG. 15b

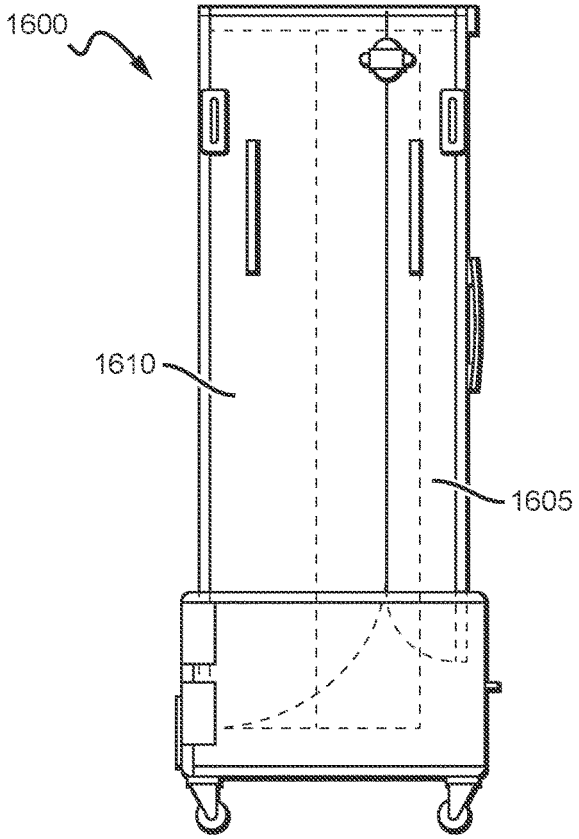
FIG. 17a
FIG. 17b
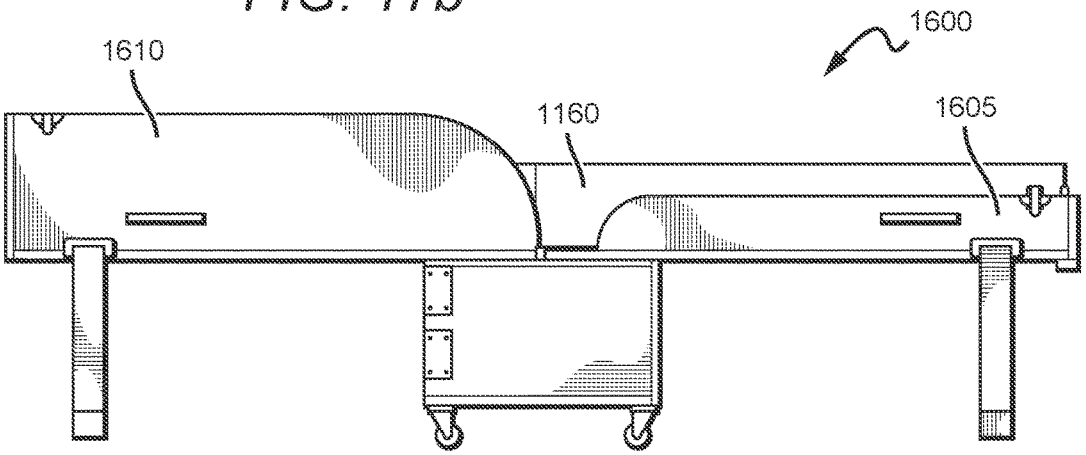

FIG. 18a
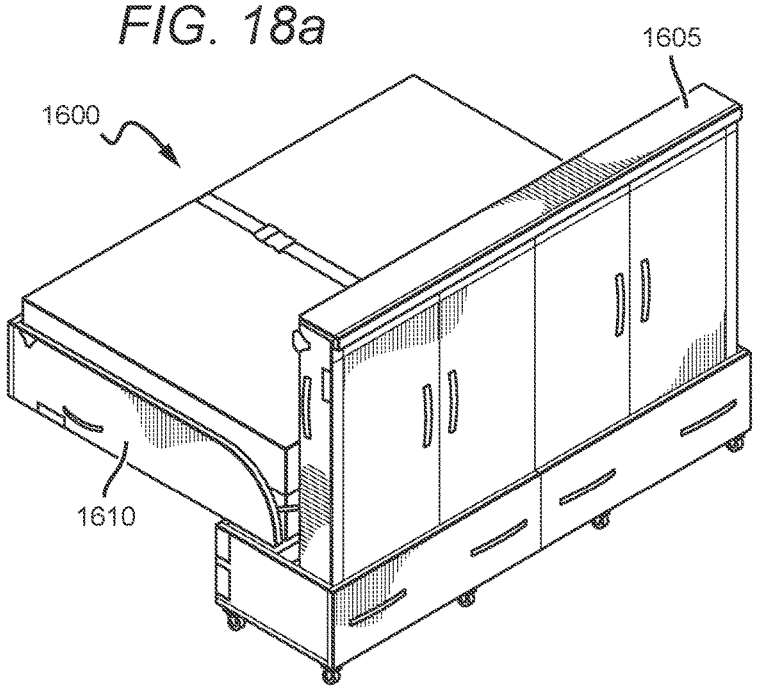
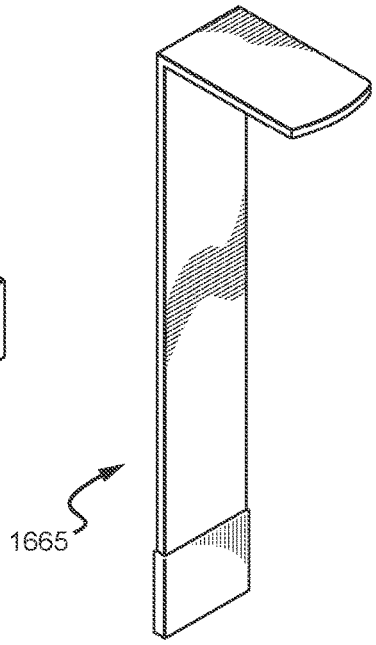
FIG. 18c
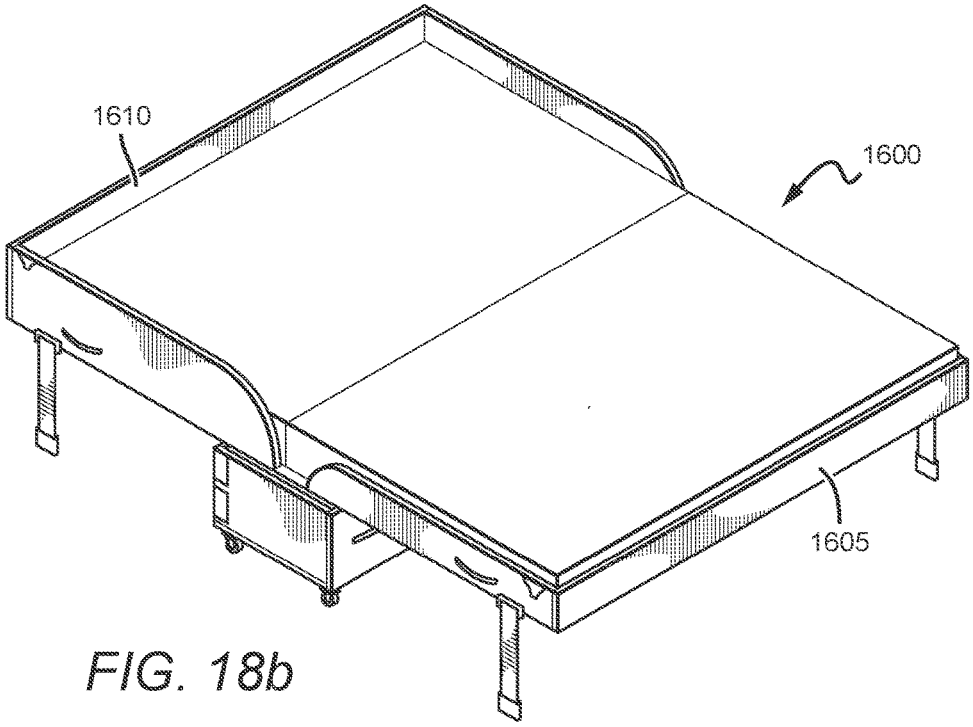
FIG. 18b

FIG. 19a
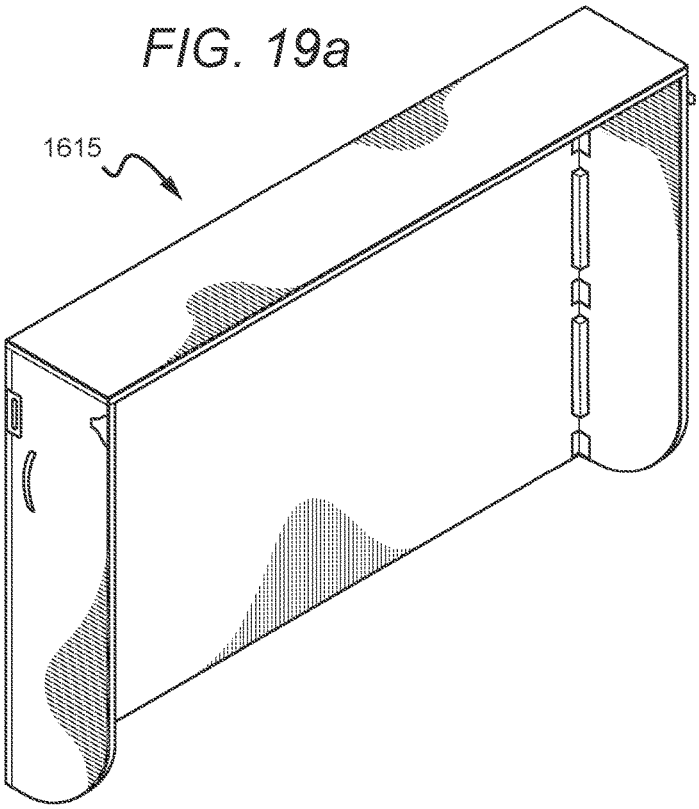
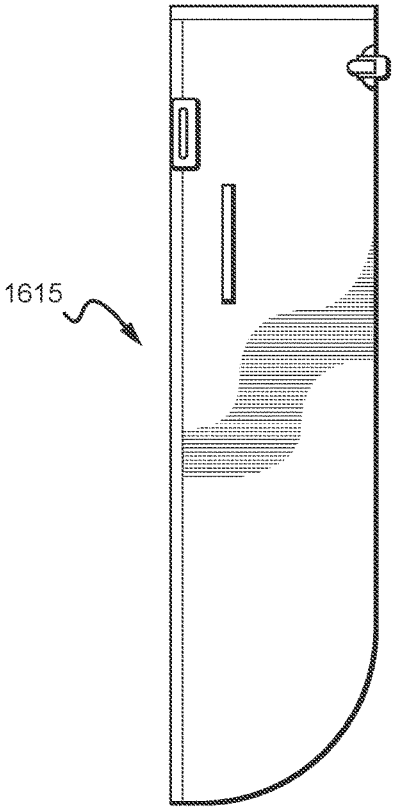
FIG. 19c
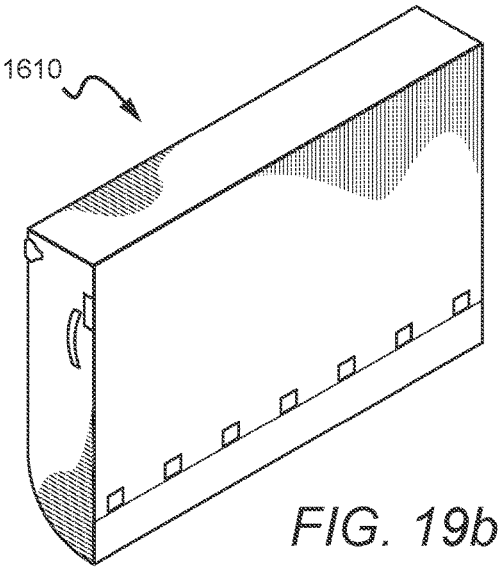
FIG. 19b

ROLLING FOLDOUT CABINET BED

This application claims the benefit of priority to U.S. Provisional Application Ser. No. 62/043,222, filed on Aug. 28, 2014. All extrinsic materials identified herein are incorporated by reference in their entirety.

FIELD OF THE INVENTION

The field of the invention is furniture, more particularly, foldout beds.

BACKGROUND

The background description includes information that may be useful in understanding the present invention. It is not an admission that any of the information provided herein is prior art or relevant to the presently claimed invention, or that any publication specifically or implicitly referenced is prior art.

In order to conserve floor space in a room it is known to provide a foldout bed that can be folded up when not in use. Such beds are sometimes designed to resemble furniture such as a cabinet, armoire, sofa, or shelf, adding to the esthetic appearance of the room. U.S. Pat. No. 5,446,932 to Voorhis, for example, teaches a wall-mounted foldable bed cabinet that can be folded up against a wall when not in use. While advantageous in some aspects, this approach has certain disadvantages. In particular, mounting the bed cabinet to a wall takes time, can cause damage to the building structure, and prevents the cabinet from being mobile.

U.S. Pat. No. 218,678 to Koskul teaches a foldout bed that resembles a stand-alone cabinet when in the folded configuration. The Koskul design advantageously avoids the need to mount the bed to a wall by allowing each face of the cabinet to fold open. However, numerous problems remain in the art of such "dual-opening" foldout cabinet beds. First, the mattress in Kodkul's bed is made in two unconnected parts, which can be uncomfortable to sleep on due to the seam between the two unconnected mattress parts. Second, the mechanism for unfolding the bed and supporting the mattress is complex, which adds unnecessary weight to the cabinet and introduces unnecessary points of failure. Third, the mechanism can also be difficult to manufacture, assemble, and install.

U.S. Pat. No. 6,851,139 to Arason teaches a dual-opening foldout cabinet bed having wheels. However, numerous disadvantages are associated with this design. First, the center of gravity is too high in the folded up configuration, making the cabinet very instable, especially when pushed or moved. Second, the cabinet is too close to the ground when in the open configuration, making access to the bed difficult and undesirable for sitting and sleeping. Third, the design has many sharp edges, making the cabinet unsafe. Fourth, opening the cabinet requires much caution since the sides can fall down by themselves. Fifth, when the cabinet is in the open configuration, the mattress is not fully enclosed and can slide off of the cabinet. Sixth, an innerspring mattress is too rigid to be stored in the folded configuration within the cabinet. Finally, the foam (futon) mattress used in the cabinet bunches up when it is stored, creating dents, creases, and an irregular and uncomfortable sleeping surface. In sum, various drawbacks remain in the art of foldout cabinet beds.

U.S. Pat. No. 83,936 to Crosby teaches a dual-opening foldout cabinet bed. However, Crosby does not provide a solution to storing a mattress inside the space of the closed cabinet in a manner that allows for the cabinet to transition from a folded configuration to an open configuration. Furthermore, Crosby also fails to provide a foldout cabinet bed that allows the user to comfortably sit on the edge of the bed without the rails pinching into the underside of the legs.

Other examples of foldout beds are disclosed in U.S. Pat. No. 5,440,768 to Danin, U.S. Pat. No. 5,386,601 to Kohl, U.S. Pat. No. 192,621 to Williamson, U.S. Pat. No. 201,282 to Ogborn, U.S. Pat. No. 213,001 to Stanton, U.S. Pat. No. 261,053 to Shupe, U.S. Pat. No. 431,825 to Sundback, U.S. Pat. No. 6,425,151 to Barnett, U.S. Pat. No. 7,013,506 to Revels. Unfortunately, these designs also suffer from one or more of the disadvantages discussed above.

Many of the deficiencies described above have been addressed in the inventor's previously filed patent application, U.S. Pat. No. 8,572,776 to Grubb. However, that patent application does not explicitly address the need for a foldout bed that provides a user with a comfortable area to sit without the rails pinching into the underside of the user's legs.

These references and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is still a need for an improved rolling foldout cabinet bed.

SUMMARY OF THE INVENTION

The inventive subject matter provides apparatus, systems, and methods in which a foldout cabinet bed comprises two faces hingeably coupled with a base and a foldable mattress. By rotating the faces with respect to the base, the cabinet bed is transitionable between a closed configuration and an open configuration. In the open configuration, the two faces are positioned horizontally and the foldable mattress can be extended across the major surfaces of the two faces and used as a sleeping surface. In the closed configuration, the two faces are positioned vertically and, with the base, create an enclosure that is suitable for storing the foldable mattress.

In one aspect of some embodiments, each face has two side rails for containing the mattress and providing an enclosure. At least one of the rails has a height (or a section with a height) that is less than the thickness of the mattress. This rail (or this section of the rail) provides a comfortable sitting surface that allows a user to sit on the edge of the mattress without the rail pressing into the underside of the user's legs.

In another aspect of some embodiments, one face includes a head board and the other face includes a foot board. When the foldout cabinet bed is in the closed configuration, the head board and foot board come together to form a horizontal top surface of the cabinet bed. When the cabinet bed is in the open configuration, the head board and foot board are positioned vertically, one at each end of the extended cabinet bed. The head board can have a larger height than the foot board to provide an enclosure that prevents a mattress and pillow from sliding off the extended (e.g., opened) foldout cabinet bed.

In yet other aspects of some embodiments, the base of the foldout cabinet bed includes four wheels that allow the cabinet bed to be easily moved when in the closed configuration.

All suitable materials and configurations for foldable mattresses are contemplated, including inner spring, foam, and futon mattresses. The head and foot ends of the mattress can be parts of the same continuous unit, or can be split into two or more sections. Where the mattress extends as a single unit from head to foot, the mattress preferably folds in the middle, with the folded area fitting into an interior space of a base portion of the cabinet when the cabinet is in a closed configuration. Where the mattress comprises two or more sections, the abutting ends of two of the sections fit into the interior space when the cabinet is in the closed configuration.

From a method perspective, a cabinet bed has a mattress with a portion that is drawn up out of the base of the cabinet bed during deployment of the bed. That portion can either comprise a fold of a single-piece mattress, or abutting ends in a two-piece mattress. The portion that is drawn up out of the base can either be pulled or pushed out of the base. In especially preferred embodiments, a belt or retainer can be used to hold both head and foot ends of the mattress to one of the cabinet's faces (e.g., sides), allowing the entire mattress to be pulled up and out of the interior space of the base when opening the cabinet.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a front perspective view of one embodiment of a foldout cabinet bed in a closed configuration.

FIG. 2 is a side perspective view of one embodiment of a foldout cabinet bed in an open configuration, with the mattress held to one of the faces of the cabinet by a retainer.

FIG. 4*c* is a perspective view of a hinge for coupling the first and second faces to the base of the foldout cabinet bed of FIG. 2.

FIG. 5*a* is a side view of a cabinet bed having a catch for holding a face of the cabinet in a substantially vertical disposition.

FIG. 5*b* is a perspective close-up view of a leg for supporting the faces when in the open configuration.

FIG. 15*a* shows a front perspective view of the base of the cabinet bed of FIG. 10.

FIG. 15*b* shows a back perspective view of the base of the cabinet bed of FIG. 10.

FIG. 17*a* shows a side view of the cabinet bed in FIG. 16 in a folded configuration.

FIG. 17*b* shows a side of the cabinet bed in FIG. 16 in an open configuration.

FIG. 18*a* shows a perspective view of the cabinet bed of FIG. 16 in a partially open configuration.

FIG. 18*b* shows a perspective view of the cabinet bed of FIG. 16 in an open configuration.

FIG. 18*c* shows a close-up view of an insertable leg with rubber padding.

FIG. 19*a* shows a perspective view of the inside of one of the faces of the cabinet bed of FIG. 16.

FIG. 19*b* shows a perspective view of the outside of the face of FIG. 19*a*.

FIG. 19*c* shows a side view of the face of FIG. 19*a*.

DETAILED DESCRIPTION

Figure 3:
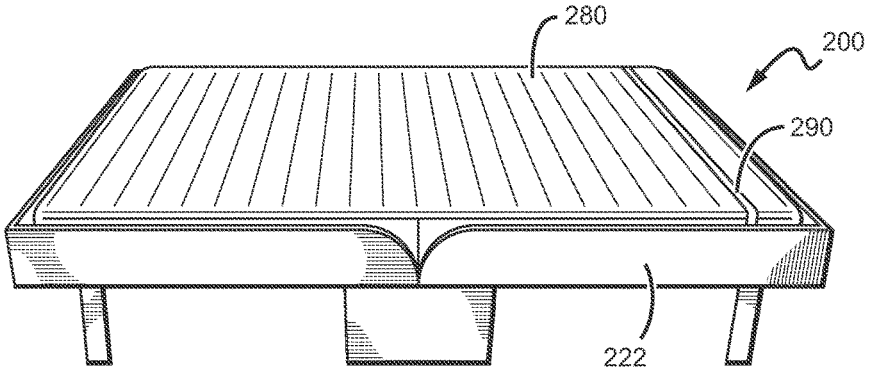
FIG. 3 is a side perspective view of the foldout cabinet bed of FIG. 2, where the mattress is unfolded to lie out upon both faces.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 shows a foldout cabinet bed 100 in a folded configuration. Cabinet bed 100 has a first face 110, second face 120, and a base 130. Each face has two flanks, face 110 having a flank 112 and face 120 having a flank 122. Face 110 and 120 meet together at an abutment 126 when in a folded configuration, and their bottom ends fit into base 130. First face 110, second face 120, and base 130 are all designed to resemble a cabinet. Base 130 has caster wheels 150 for moving cabinet bed 100. Leg 160 is one of four legs that folds out and supports the first or second face above ground while in the open configuration. Catch 170 releasably attaches face 110 to face 120, maintaining cabinet 100 in a folded configuration before release. Catch 170 could also comprise two separate catches; one that releasably attaches first face 110 to base 130 and another that releasably attaches second face 120 to base 130.

As used herein, "face" means a portion of a cabinet that defines a side (which could be front or back "sides") of the cabinet. The first and second faces preferably define a partially enclosed region suitably sized and dimensioned to house a folded mattress when the cabinet is in a folded configuration.

As used herein, the term "folded configuration" means a configuration in which lengths of first and second faces run next, and substantially parallel, to one another. "Substantially parallel" means that the acute angle of the intersection of the lengths of first and second faces is less than 10°, more preferably less than 5°, and most preferably less than 1°. As used herein, the term "open configuration" means the first and second faces of the bed have been configured to accommodate a person for sitting or lying down. Thus, as used herein the term "open configuration" includes a configuration in which one of the faces is laid horizontal, but the other face is still vertical. In a preferred open configuration, the faces are positioned such that they create a substantially horizontal surface upon which the mattress can rest, allowing a user to comfortably rest or sleep. In another open configuration the first face is parallel to the ground while the second face is at a 135° angle, providing an inclined surface for lying. One of ordinary skill in the art will appreciate that an open configuration can comprise various positions and angles of the first and second faces.

First face 110 rotates about base 130 via hinges 140, rotating from a substantially vertical disposition to a substantially horizontal disposition. Second face 120 also rotates about base 130 in a similar manner. Since both face 110 and 120 open up, cabinet 100 can be described as a "dual-opening" foldout cabinet bed. Hinges 140 are shown just above base 130 for demonstrative purposes; however hinges 140 could be hidden between first face 110 and base 130.

As used herein, the term "substantially vertical" means the overall length of an object is substantially perpendicular to the ground, within ±5°, more preferably within ±2.5°, most preferably within ±1°. "Substantially horizontal" means the overall length of an object is substantially parallel to the ground, preferably having an acute angle of intersection with the ground of less than 10°, more preferably less than 2.5°, most preferably less than 1°. Under these definitions objects can be substantially vertical or substantially horizontal even though they are not flat.

Faces 110 and 120, and base 130 are sized and dimensioned to house a folded mattress having a standard size, such as a twin, x-long twin, full, queen, king, or California king size. However, it is also contemplated that faces 110 and 120, and base 130 could be sized and dimensioned to house a "custom" sized mattress, i.e. a size not commonly sold on the market. It is also contemplated that the faces and base could be sized and dimensioned to house a mattress suitable for a pet, such as a cat or dog. While most mattresses have a general rectangular shape, one skilled in the art will appreciate that the inventive concepts taught herein could apply to a mattress having a non-rectangular shape as well. It is further contemplated that the cabinet could optionally include a space for storing things other than, and in addition to, a mattress. For example, beneath base 130 there could be a drawer for storing mattress sheets and pillows.

Caster wheels 150 allow cabinet bed 100 to be stored against a wall when not in use and later rolled away from the wall when used. In a preferred embodiment the wheels have locks for preventing the cabinet from moving. It is also contemplated that non-caster wheels or a combination of caster and non-caster wheels could be used with cabinet 100. Moveable furniture is well known and one of ordinary skill in the art will appreciate that other friction-reducing mechanisms and designs could be used with cabinet 100 in order to facilitate its movement. Unlike previous dual opening cabinet designs, the design of the cabinet bed taught herein provides a low center of gravity, allowing the cabinet to be pushed or pulled safely without the risk of falling over.

The legs preferably resemble parts of a cabinet, such as a drawer handle, and thus are "hidden" when the bed cabinet is in a folded configuration. The legs are also preferably sized such that the faces 110 and 120 are substantially horizontal, providing a flat and level surface for sleeping. However, it is also contemplated that the legs could be sized to create an inclined surface for allowing a person to lie in an inclined configuration. The length of the legs could also be adjustable, allowing the bed to lay open in a level manner, even when the ground is not level. Bubble levels or accelerometers could be integrated within the faces in order to indicate whether the faces are level when in the open configuration.

Cabinet 100 can be made of any material which can provide the structural strength required to support a person's weight. The material is preferably inexpensive and easy to manufacture. Wood is especially preferred since it is strong, inexpensive, easy to cut and shape, and can be varnished or finished to provide an attractive appearance. However, other materials such as plastic, metal, ceramic, composite, or any combination thereof, could be used to make a foldout cabinet bed. While cabinet bed 100 resembles a cabinet, cabinet 100 could also be made to resemble other pieces of furniture, for example, an armoire, or a shelf or drawer cabinet. Additionally, the design and style of cabinet 100 could resemble a particular style of furniture in order to match an interior design of a room. In one embodiment, a foldout bed cabinet intended for use in a garage resembles a tool cabinet commonly sold on the market.

FIG. 2 shows a cabinet bed 200 in an open configuration. First face 210 and second face 220 are connected to base 230 via hinges 240, and are being supported above the ground by legs 260. A mattress 280 is housed within the region enclosed by face 210, face 220, and their corresponding flanks, flank 212, 214 (not shown), 222 and 224. Retainer belt 290 straps around mattress 280 and holds it to face 210. Once face 210 and face 220 have been opened, belt 290 can be released and mattress 280 can be unfolded. Mattress 280 has optional joint 285, which allows a one-piece mattress 280 to fold and unfold. A mattress having separable head and foot ends, of course, would omit the joint 285, and FIG. 2 should be interpreted as contemplating both a one-piece mattress and a mattress having separable head and foot ends. FIG. 2 also shows optional hook and loop or other fasteners 286A, 286B that assist in securing the head and foot ends of the mattress 280 with respect to one another.

FIG. 3 is a side perspective view of the foldout cabinet bed of FIG. 2, where the mattress is unfolded to lie out upon both faces.

In FIG. 3, retainer 290 is shown as an elastic belt that stretches from flank 212 to opposing flank 214 (not shown), and tightly presses folded mattress 280 to face 210. However, retainer 290 could be any design or configuration for extracting mattress 280 from the interior space of base 230. In another embodiment, a hook and loop (Velcro) strap is used to hold folded mattress 280 to face 210. Releasable fasteners are well known and one skilled in the art will recognize that various embodiments of fasteners can be used to hold folded mattress 280 to face 210.

Retainer 290 can have various different functions. One function is to pull a portion of the mattress 280 out of the interior space of base 230 when the cabinet is transitioning from a folded configuration to an open configuration. Retainer 290 can also prevent the mattress from falling into the interior space of base 230 when the cabinet is transitioning between open and folded configurations.

A suitable retainer could be located in any suitable position and orientation, as for example on face 220 rather than 210. For example, a retainer could be an elastic strap the stretches from the bottom end of face 210 to the bottom end of face 220, and passing underneath mattress 280. In this manner, the retainer would push mattress 280 out of the interior space of base 230 when the cabinet is transitioned from a folded configuration to an open configuration. In yet another embodiment, retainer could comprise a foot pedal and lever located beneath the mattress, which acts to push the mattress out of the interior space of base 230.

Figure 4A:
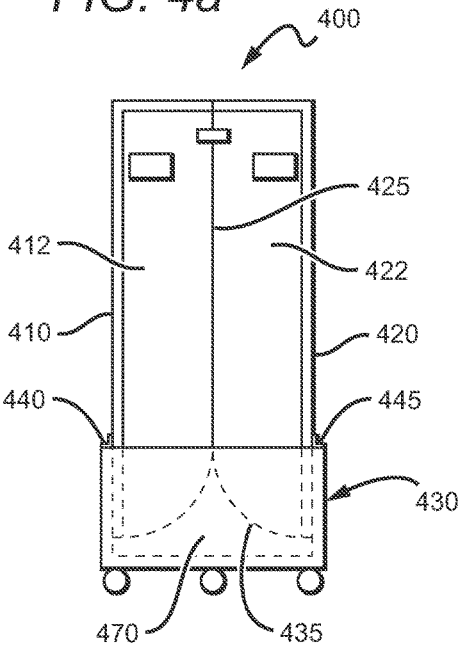
FIG. 4*a* is a side view of the foldout cabinet bed of FIG. 2, in a closed configuration.
Figure 4B:
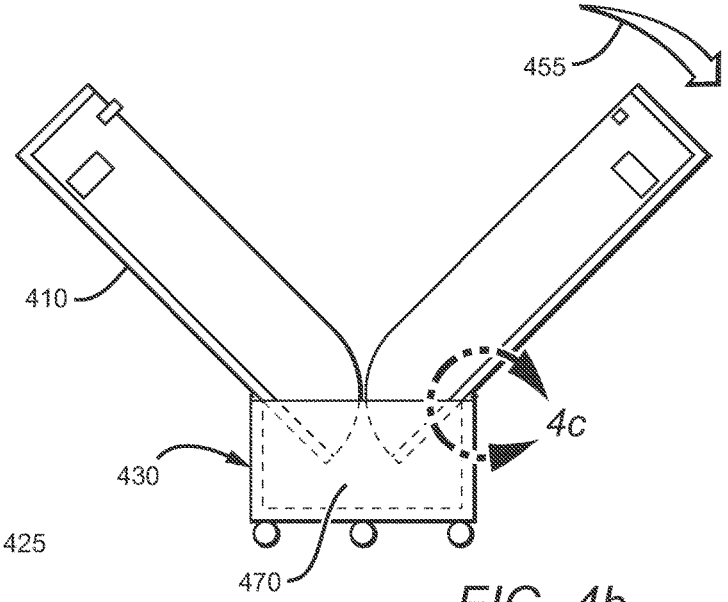
FIG. 4*b* is a side view of the faces of the foldout cabinet bed of FIG. 2, in a partially opened configuration.

FIG. 4*a* is a side view of a cabinet bed 400 in a folded configuration. Cabinet bed 400 has a first face 410, a second face 420, and a base 430. Each face has two flanks, face 410 having flank 412, and face 420 having flank 422. Abutment 425 is where the edges of flanks 412 and 422 meet. The bottom ends of flanks 412 and 422 are shaped with a curvature 435 which allows face 410 and 420 to open without pushing against each other. Curvature 435 also advantageously minimizes the number of exposed sharp points, providing a safer bed design. Base 430 defines an interior space 445. In the embodiment of FIG. 4*a*, face 410 and 420 rotate about base 430 via hinges 440 and 445, respectively. A folded mattress within the cabinet can be releasably attached to face 410 or 420 via a retainer (shown in FIG. 2) such that, as face 410 and 420 are rotated open, the mattress is pulled out of interior space 445. The retainer also prevents the mattress from falling into interior space 445 when the cabinet is being closed. FIG. 4*b* shows the cabinet bed 400 in a partially open configuration. Arrow 455 in FIG. 4*b* shows rotation of face 420 about base 440. FIG. 4*c* shows a close-up of hinge 445, with screw holes 442 and pivot 444.

FIG. 5*a* shows a side view of cabinet 400 in a partially open configuration. Cabinet 400 has a removable leg 460, which supports face 420 above the ground when in a substantially horizontal disposition. Each of face 410 and 420 preferably has at least two legs for supporting the faces above ground when the cabinet bed is in the open configuration. FIG. 5*b* is a close-up of leg 460, showing how the end of leg 460 fits into bracket 465, which is attached to face 420. Leg 460 is preferably inserted into bracket 465 just before unfolding the faces 410 and 420. Bracket 465 is preferably designed to resemble a part of a cabinet such that it is "hidden" when cabinet bed 400 is closed. FIG. 5*a* also shows a catch 405 that holds face 410 in a substantially vertical position. Catch 405 advantageously prevents face 410 from falling down when face 420 is being repositioned from a substantially vertical to a substantially horizontal position. While FIG. 5*a* shows catch 405 on the outside of cabinet 400, catch 405 can alternatively be located on the inside of cabinet 400 (e.g., between mattress 280 and rails 412, 422) so that it is hidden when cabinet 400 is stored in the folded configuration.

Leg 460 can alternatively be integrated within the cabinet. For example, telescopic legs could be stored within the thickness of the walls of first and second faces. Such legs could be extended and locked in position when the bed is in an open configuration, and then retracted and hidden when the bed is in a folded configuration. In another embodiment, the legs could be hingeably attached to the exterior of the first and second faces 410 and 420, and then be pivoted out when the bed is in an open configuration. One of ordinary skill in the art will recognize that many other leg designs and configurations would be compatible with the inventive concepts taught herein.

Figure 6:
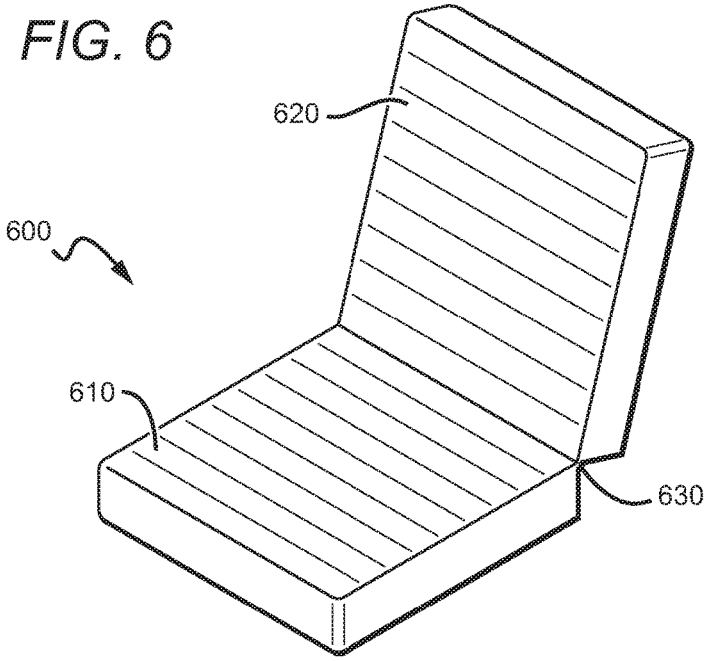
FIG. 6 is a perspective view of a mattress.

FIG. 6 shows a mattress 600 for use with cabinet bed 400. Mattress 600 has a head end 610, a foot end 620, and a connecting fabric 630. Fabric 630 connects the head and foot ends such that mattress 600 is regarded herein as a one-piece mattress. Fabric 630 also provides a flexible joint for folding foot end 620 onto head end 610.

Mattress 600 can be made of any material that provides a suitable surface area for sleeping or resting. Mattress materials are well known, and various designs and configurations have been utilized over the centuries. For example, cotton, foam (e.g., Tempur-Pedic™), springs, water, and air are all common mattress materials. Previous dual-opening foldout cabinet beds have failed to provide a simple cabinet design for housing a comfortable innerspring mattress. While all suitable mattress materials are contemplated, the cabinet beds taught herein advantageously utilize a simple cabinet design that is capable of functioning with an innerspring mattress.

Figure 7:
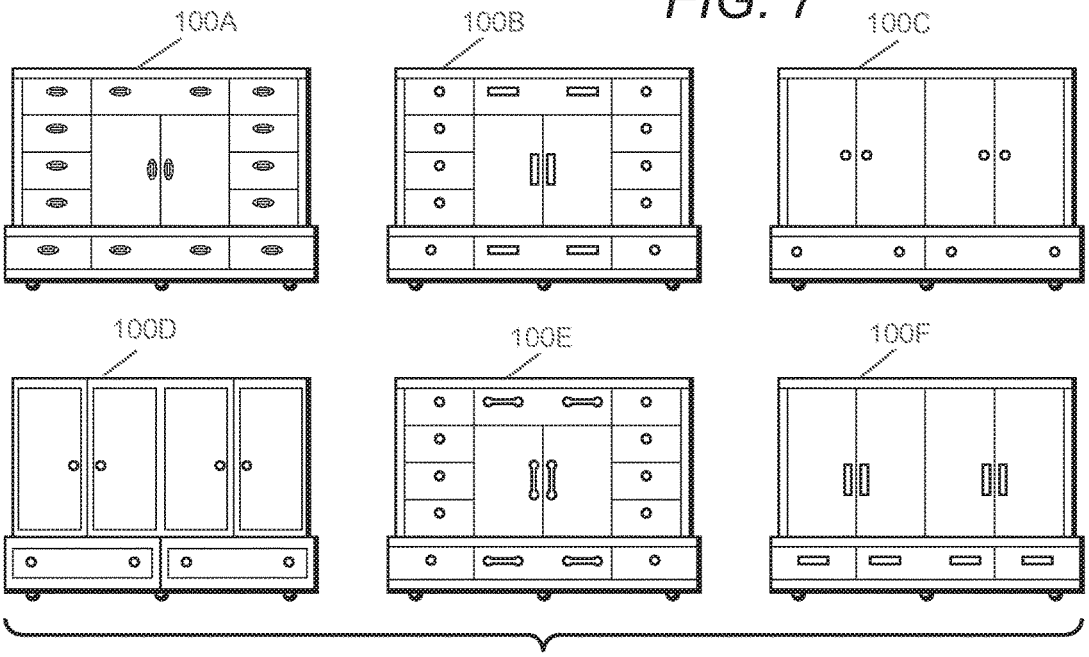
FIG. 7 shows six different exterior designs for foldout cabinet beds.

FIG. 7 shows six different designs, 100A, 100B, 100C, 100D, 100E and 1007F resembling a cabinet. The shape of the drawer handles, color of the cabinet, materials used, surface finish, number of drawers, and other various aspects of the cabinet bed can be configured to match a specific interior design or style.

Figure 8:
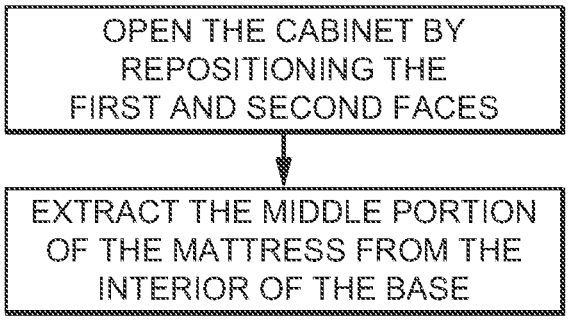
FIG. 8 is a schematic of a method of deploying a foldout cabinet bed.

FIG. 8 shows a schematic of steps for a method of deploying a foldout cabinet bed. The method includes the steps of (i) opening the cabinet by repositioning the first and second faces of the cabinets, and (ii) extracting the middle portion of the mattress from the interior space of the cabinet's base. In embodiments where a rigid mattress occupies the interior space of the base, the step of extracting the mattress from the interior space is preferably performed before or simultaneously with the step of opening the cabinet.

The step of opening the cabinet can be performed by releasing a catch that holds the first and second faces together, and then manually pivoting the faces against the base. In this manner, the faces are pivoted from a substantially vertical position to a substantially horizontal position. The step of opening the cabinet could also be performed in an automated fashion by using a motor to unwind a cord that is connected to the first and second faces in such a manner that the faces are pivoted against the base and repositioned from a vertical disposition to a horizontal disposition. The motor could optionally be actuated via a wireless signal. It is further contemplated that the step of opening the cabinet could be performed by repositioning the faces either simultaneously or in two separate steps. A linkage similar to that in Koskul could be used to stabilize the faces as they fold and unfold simultaneously. In one embodiment, the method is performed by repositioning the first face and extracting the middle portion of the mattress out from the interior space simultaneously, and then repositioning the second face.

As used herein, the term "extracting" means removing or displacing. The step of extracting the middle portion of the mattress from the interior space of the base could be performed by fastening both ends of the folded mattress to a face with a retainer, such that when that face is repositioned from a vertical to a horizontal position the mattress is pulled out of the interior space. In this manner, the step of opening the cabinet and the step of extracting the middle portion of the mattress are performed simultaneously. The retainer could be an elastic belt, a hooks-and-loops strap (Velcro strap), or any other fastener suitable for releasably holding the folded mattress to one of the faces. The step of extracting the middle portion of the mattress could also be performed by stepping on a foot petal located underneath the base, causing the mattress to be pushed out of the interior space via a mechanical lever. In yet another embodiment, the retainer is an elastic cord stretching from the bottom end of the first face to the bottom end of the second face, causing the mattress to be pushed out of the interior space when the faces are repositioned from a vertical to a horizontal disposition. Various designs and configurations can be employed in order to perform the step of extracting the middle portion of the mattress from the interior portion of the base.

Figure 9:
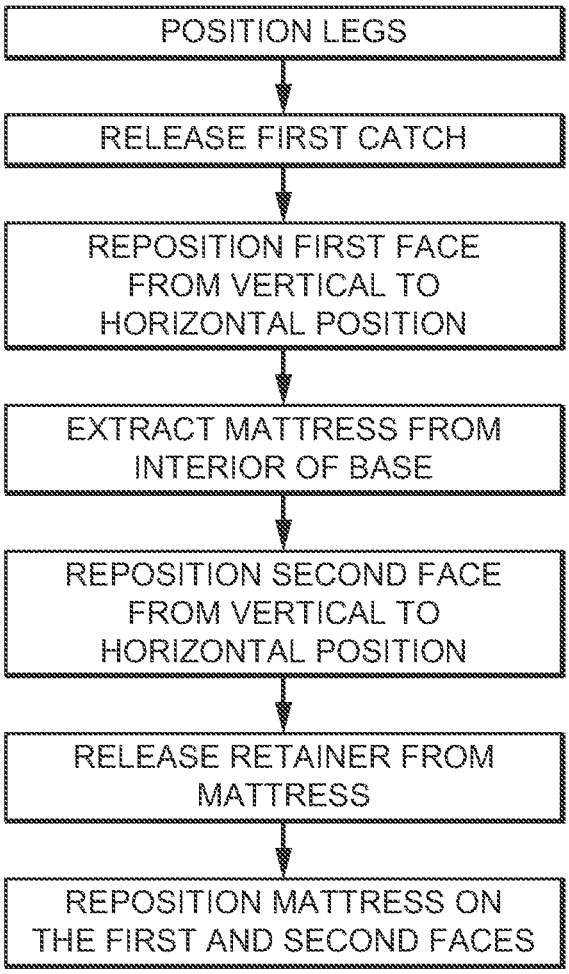
FIG. 9 is a schematic of a method of using a foldout cabinet bed.

FIG. 9 shows a schematic of steps for a method of using a foldout cabinet bed. First, legs on the cabinet are positioned so that, when the first and second faces of the cabinet are opened, the legs support the faces above the ground. For example, this step could be performed by extending telescopic legs located within the cabinet, inserting legs into slots on the cabinet, or sending a wireless signal to controls within the cabinet that can position the legs via an actuator. Then, a first catch is released, allowing the first face of the cabinet to unfold. It is contemplated that the step of releasing a first catch could be performed before the step of positioning the legs. However, positioning the legs before releasing the first catch will ensure that the first face of the cabinet does not fall down while positioning the legs. It is further contemplated that the first catch could release the second face rather than the first face. It is not essential that the first face be unfolded first. It is also contemplated that the first catch could release both the first and second faces of the cabinet, allowing both to be unfolded simultaneously or in any desired order.

After the first catch is released, the first face is unfolded by repositioning the face from a vertical position to a horizontal position. Since the mattress is fastened to the first face, the step of extracting the mattress from the interior base is performed simultaneously with the step of repositioning the first face. Next, where a second catch is used to secure the second face in place while the first face is being unfolded, and then the step of releasing the second catch can be performed (not shown). The second face of the cabinet can then be unfolded. The retainer holding the mattress to the first face is then released. In one embodiment, this step is performed by unhooking an elastic belt that stretches across opposite edges of the first face and around the folded mattress. It is also contemplated that the step of releasing the retainer could be performed before the step of repositioning the second face. Further, in embodiments where a second catch is not used to secure the second face, the steps of repositioning the first and second faces could be performed simultaneously. Finally, the mattress is unfolded.

While it is contemplated that various steps could be preformed automatically, in especially preferred embodiment the steps are all performed manually. In this manner, the structure of the foldout cabinet bed is advantageously simplified. It is further contemplated that the steps could be performed in reverse so as to retract or fold the cabinet bed.

Figure 10:
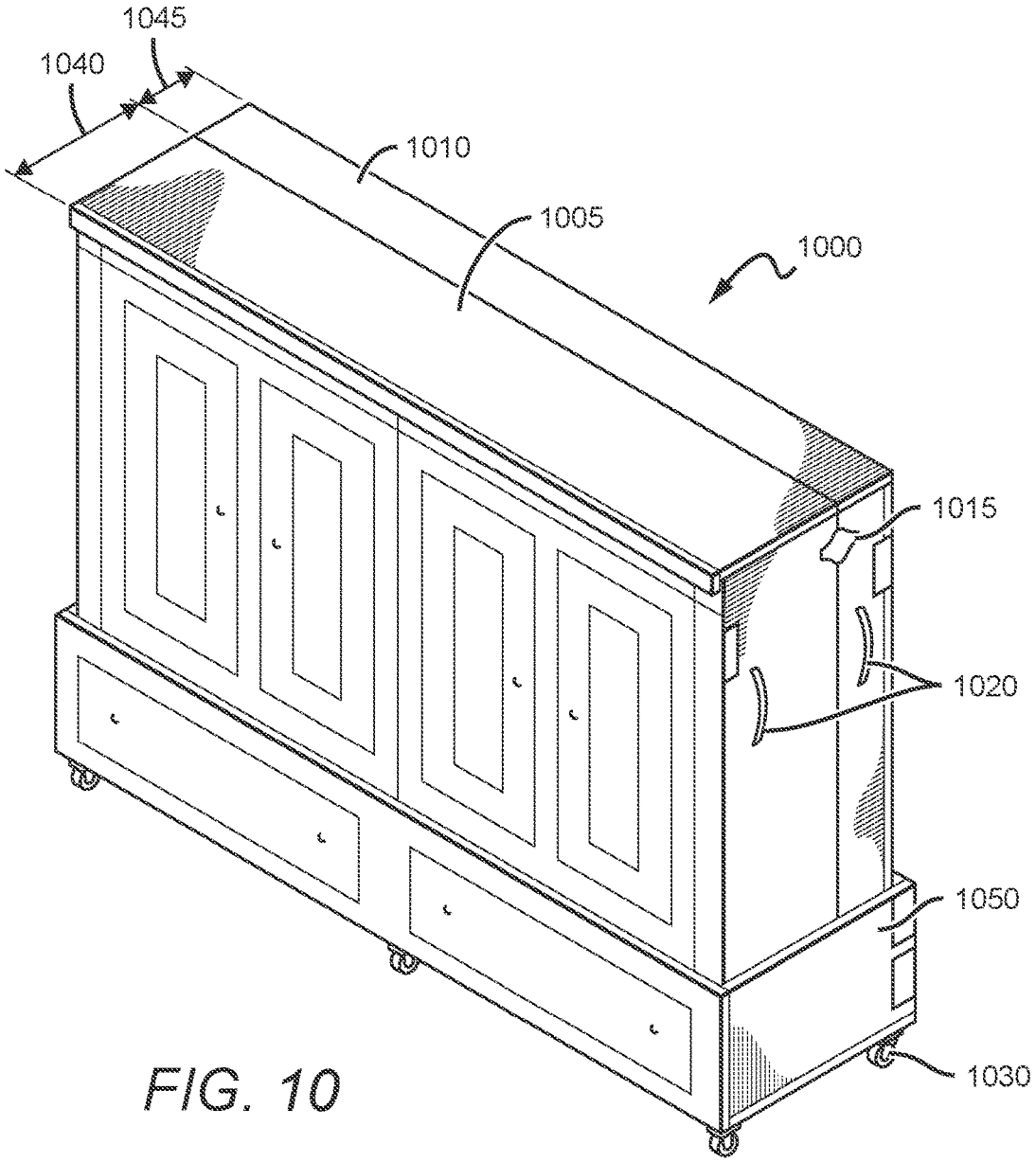
FIG. 10 shows a perspective view of one embodiment of a foldout cabinet bed.

FIG. 10 shows a perspective view of another embodiment of a foldout cabinet bed 1000, shown in a folded configuration. Cabinet bed 1000 comprises a front face 1005 and a rear face 1010 rotatably coupled with a base 1050. Cabinet bed 1000 is different from cabinet beds 100 and 200 in that dimension 1040 of first face 1005 is larger than dimension 1045 of second face 1010 (e.g., face 1005 and face 1010 have asymmetrical dimensions, unlike face 110 and face 120 of cabinet bed 100). Dimensions 1040 and 1045 are referred to herein as "rail height" and/or "rail depth". Cabinet bed 1000 is also different from cabinet beds 100 and 200 in that it has one or more handles 1020 coupled to face 1005 and face 1010 so that a user can use the handles when cabinet bed 1000 is transitioned between folded and unfolded configurations. A user also uses handles 1020 to move cabinet bed 1000 when in the folded configuration. Cabinet bed 1000 has caster wheels 1030 for moving cabinet bed 1000. Catch 1015 releasably attaches face 1005 to face 1010, maintaining cabinet bed 1000 in a folded configuration before release.

Figure 11A:
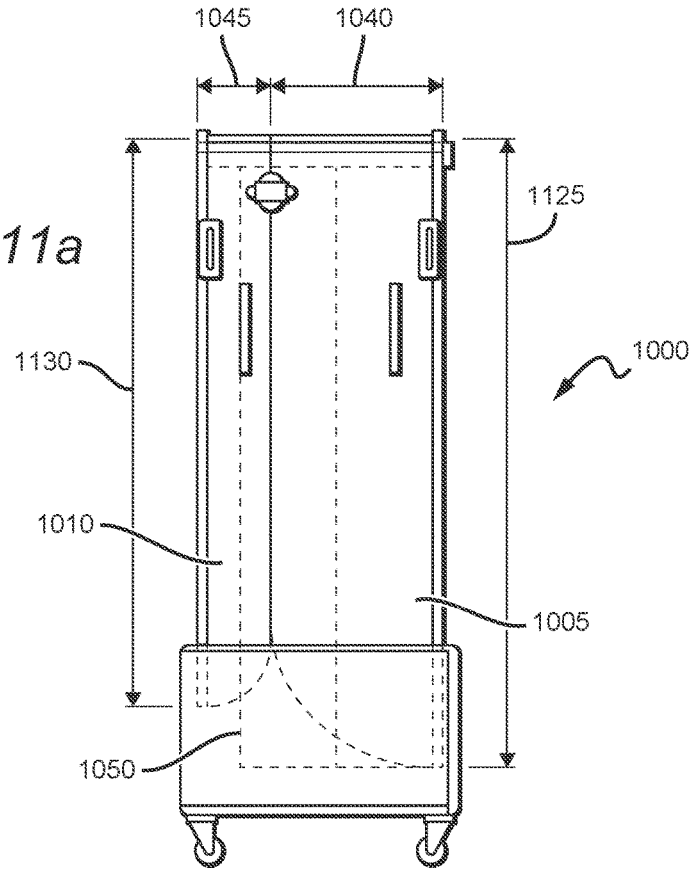
FIG. 11*a* shows a side view of the cabinet bed in FIG. 10 in a folded configuration.

FIG. 11*a* shows a side view of cabinet bed 1000 in a folded configuration. Face 1005 of cabinet bed 1000 has a dimension 1125 (e.g., rail length), which is larger than dimension 1130 (e.g., rail length) of face 1010. Face 1005 also has a dimension 1040 (e.g., rail height/depth), which is larger than dimension 1045 (e.g., rail height/depth) of face 1010. Together, dimension 1040 and 1045 are substantially equal to the width of the interior space of base 1050 and provide a complete side enclosure for storing a mattress within cabinet bed 1000. Moreover, dimension 1130 and dimension 1125 are long enough such that at least an end portion of the rails of face 1005 and face 1010 extend into the interior space of base 1050, thus providing a complete side enclosure.

Figure 11B:
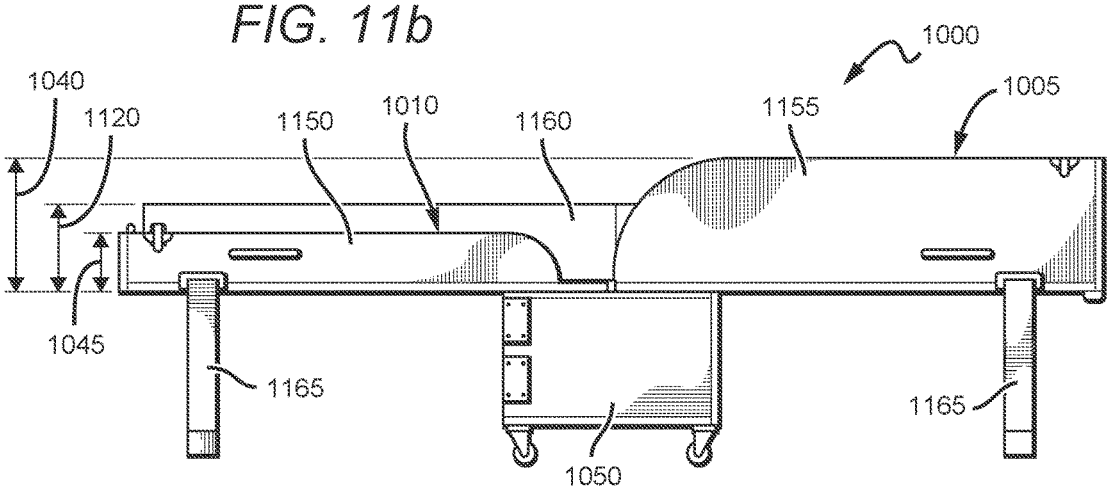
FIG. 11*b* shows a side view of the cabinet bed in FIG. 10 in an open configuration.

FIG. 11*b* shows a side view of a cabinet bed 1000 in an open configuration, where mattress 1160 is unfolded and is extended upon both face 1005 and face 1010. Dimension 1120 (e.g., thickness) of mattress 1160 is larger than dimension 1045 (e.g., rail height/depth) of rail 1150, and is smaller than dimension 1040 (e.g., rail height/depth) of rail 1155.

Rail 1150 is designed to allow a user to comfortably sit on the edge of mattress 1160 with the user's feet on the ground, without rail 1150 pressing into the underside of the user's legs. Dimension 1045 is significantly smaller than dimension 1120 such that, even when the user sits on mattress 1160 and dimension 1120 is reduced (i.e., the user's weight compresses mattress 1160), the "compressed thickness" of mattress 1160 is still larger than dimension 1045. Of course, the compressed thickness of mattress 1060 will depend on many factors such as the user's weight and the stiffness of mattress 1060. However, those of ordinary skill in the art will appreciate that various materials, sizes, and shapes for mattress 1060 can be used consistently with the inventive concepts disclosed herein. For some embodiments, mattress 1160 could be made of a stiff material. In such embodiments, dimension 1120 of mattress 1160 need only be slightly larger than dimension 1045 of rail 1150. In yet other embodiments, mattress 1160 could be made of softer and more compressible material, in which case dimension 1120 will be significantly larger than dimension 1045. The material of mattress 1160 and dimension 1045 are preferably selected such that a compression thickness of mattress 1160 is still larger than dimension 1045 for a compression force of 50 pounds, more preferably 100 pounds, most preferably 300 pounds, to thereby provide a comfortable sitting surface for youth, smaller adults, and/or larger adults.

Face 1005 is designed to function as a headboard when cabinet bed 1000 is in an open configuration. In particular, dimension 1040 is larger than dimension 1120 of mattress 1160, which provides a partial enclosure that prevents mattress 1160 from sliding off cabinet bed 1000. Dimension 1040 of face 1005 also helps to prevent pillows from falling off of cabinet bed 1000.

In alternative embodiments of cabinet bed 1000, dimension 1045 of rail 1150 and/or dimension 1040 of rail 1155 can vary along the length of the rails (e.g., the height of the rails can be sloped, concave, wavy, or even irregular). In such embodiments, at least a portion of rail 1150 has a height that is smaller than either (i) a portion of the height of rail 1155 or (ii) dimension 1120 of mattress 1160. This portion preferably has a length that is at least as long as the width of the user (e.g., about 20 inches (48 centimeters) for the average adult, or 10 inches (25.4 centimeters) for an smaller child).

FIG. 11*b* also shows insertable legs 1165 being used to support face 1005 and face 1010 above ground.

Figure 12A:
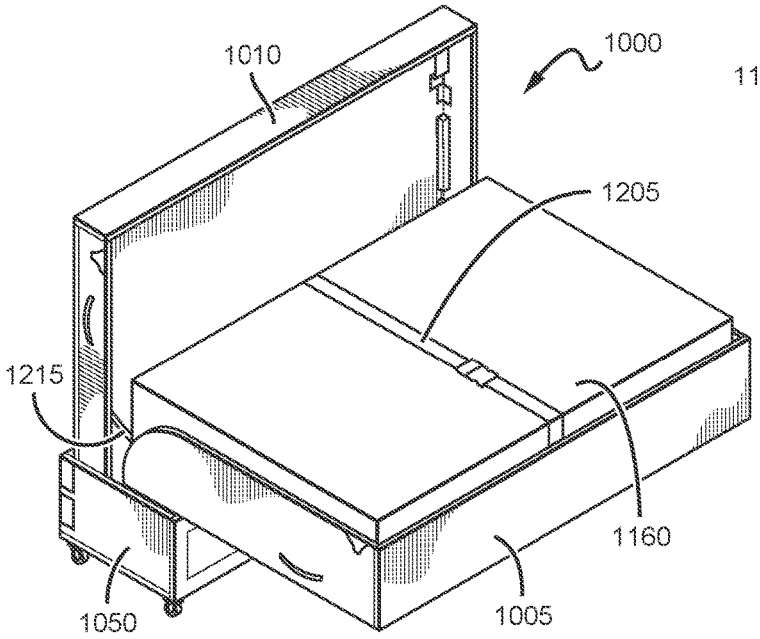
FIG. 12*a* shows a perspective view of the cabinet bed of FIG. 10 in a partially open configuration.

FIG. 12*a* shows a perspective view of a cabinet bed 1000 in a partially open configuration, where face 1005 lies out and face 1010 is in a substantially vertical position. Catch 1215 connects face 1005 to face 1010 to advantageously prevent face 1010 from falling down when face 1005 is being repositioned from a substantially vertical to a substantially horizontal position. In alternative embodiments, catch 1215 could attach face 1010 to base 1050 rather than face 1005. Catch 1215 could also attach face 1005 to base 1050. However, when catch 1215 attaches face 1005 to face 1010, as is shown in FIG. 12*a*, the user can choose whether to lower face 1005 or face 1010 first, and then release catch 1215 and lower the other face to the open configuration. Catch 1215 can comprise a cord, elastic cord, chain link, spring, or any other releasable fastener that is suitable for securing one of face 1005 and face 1010 in a substantially vertical position.

FIG. 12*a* also shows a retainer 1205 for securing mattress 1160 to face 1005. Retainer 1205 helps lift mattress 1160 out of the interior space of 1050 so that face 1005 can be lowered from a vertical position to a horizontal position (e.g., opened). Without retainer 1205, mattress 1160 would stay within the interior space of base 1050 and prevent face 1005 and face 1010 from opening. Retainer 1205 also prevents mattress 1160 from falling into the interior space of base 1050 when face 1005 and face 1010 are raised from the horizontal position to the vertical positioned (e.g., closed). In alternative embodiments retainer 1205 can be attached to face 1010 rather than face 1005, in which case the user would open face 1010 first, followed by face 1005. In yet other alternative embodiments, both face 1005 and face 1010 could have a retainer, giving the user the option of attaching mattress 1160 to either face 1005 or face 1010.

When mattress 1160 comprises two separable ends (e.g., a head end and a foot end), retainer 1205 preferably secures both ends to face 1005. When mattress 1160 is a two-piece mattress hingeably joined by a connecting fabric, again retainer 1205 preferably secures both pieces of mattress 1160 to face 1005 so that both pieces are removed from the interior space of base 1050 when face 1005 is lowered to the horizontal position.

Figure 12C:
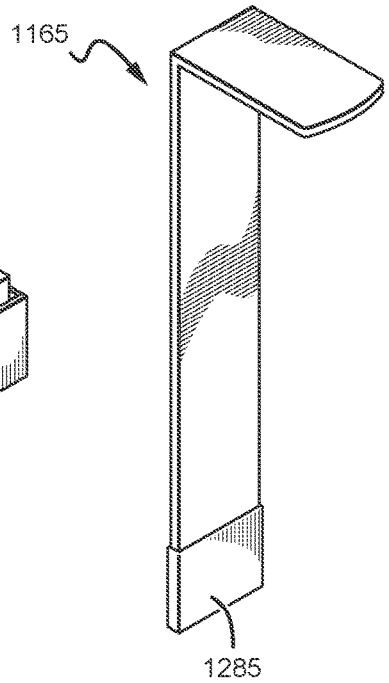
FIG. 12*c* shows a close-up view of an insertable leg with rubber padding.
Figure 12B:
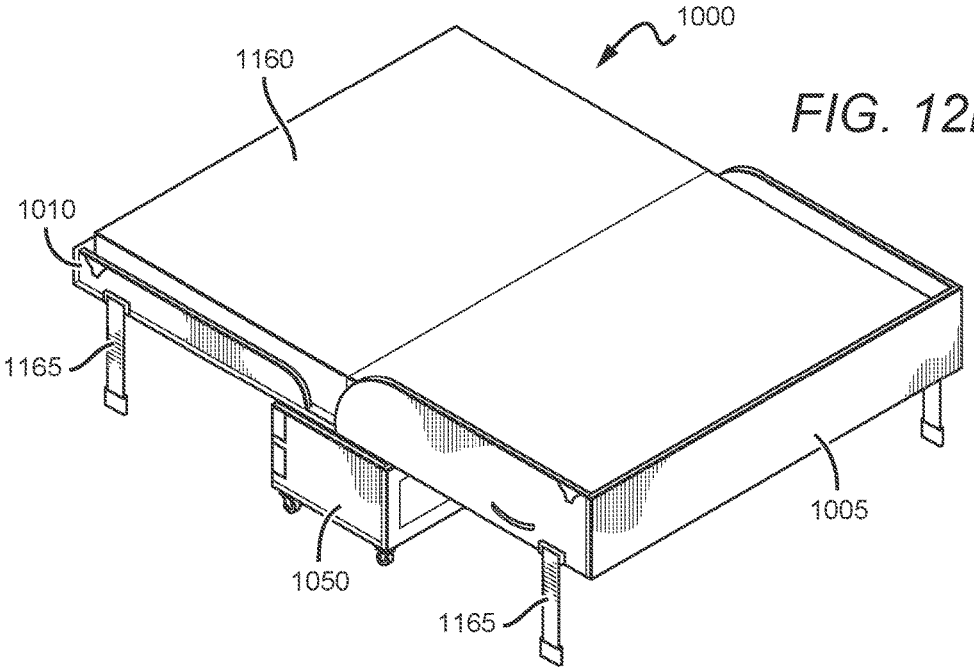
FIG. 12*b* shows a perspective view of the cabinet bed of FIG. 10 in an open configuration.

FIG. 12*b* shows a perspective view of a cabinet bed 1000 in an open configuration. Face 1005 has been lowered to the horizontal position, catch 1215 has been released from face 1010, and face 1010 has been lowered to the horizontal position. Two insertable legs 1165 have been inserted into each of face 1005 and face 1010 to support the faces off the ground. Retainer 1205 has been released and mattress 1160 has been stretched out across face 1005 and face 1010.

FIG. 12*c* shows a close-up view of insertable leg 1165. Insertable leg 1165 has a height that is about the height of base 1050. A portion of insertable leg 1165 is surrounded by a rubber padding 1285. Rubber padding 1285 is located at the bottom part of insertable leg 1165 to prevent insertable leg 1165 from sliding and scrapping the floor when insertable leg 1165 is positioned to support cabinet bed 1000 in the open configuration.

Figure 13A:
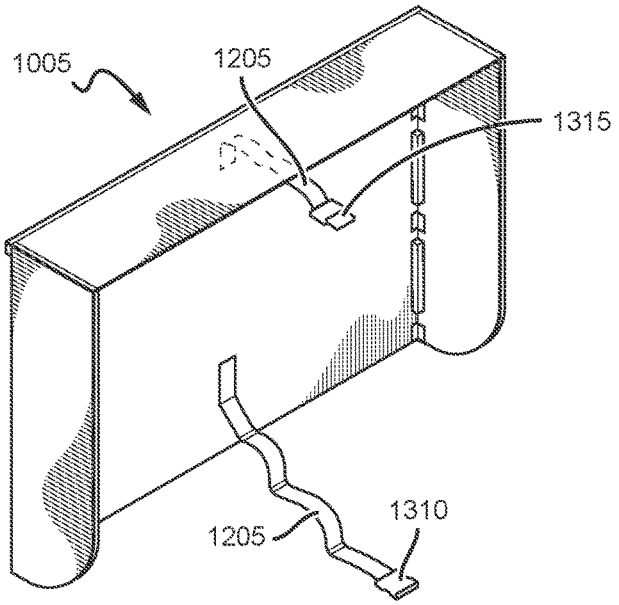
FIG. 13*a* shows a perspective view of the inside of one of the faces of the cabinet bed of FIG. 10.

FIG. 13*a* shows a perspective view of the inside of face 1005. Face 1005 can serve as the head board side of cabinet 1000. Face 1005 has a retainer 1205 that comprises a female strap 1310 attached to the bottom end of face 1005, and male strap 1315 attached to the top end of face 1005. Female strap 1310 removably couples with male strap 1315 (e.g., snap-locks) such that retainer 1205 can be used to secure mattress 1160 to face 1005. In alternative embodiments, retainer 1205 could comprise another type of releasable fastener, such as buckle straps, hooks-and-loop fasteners, magnetic fasteners, button snap fasteners, and so forth. In yet other alternative embodiments, retainer 1205 could stretch across the length of face 1005 rather than the width, or even diagonally. (Although, orienting retainer 1205 across the width of face 1005 as shown in FIG. 13*a* helps to directly counter the weight of mattress 1160 when face 1005 is opened). Those of ordinary skill in the art will appreciate that numerous variations of retainer 1205 can be used without departing from the inventive concepts herein. Retainer 1205 could be any design or configuration suitable for securing mattress 1160 to a face of cabinet bed 1000 so that mattress 1160 is removed from the interior space of base 1050 when a face is opened.

Figure 13C:
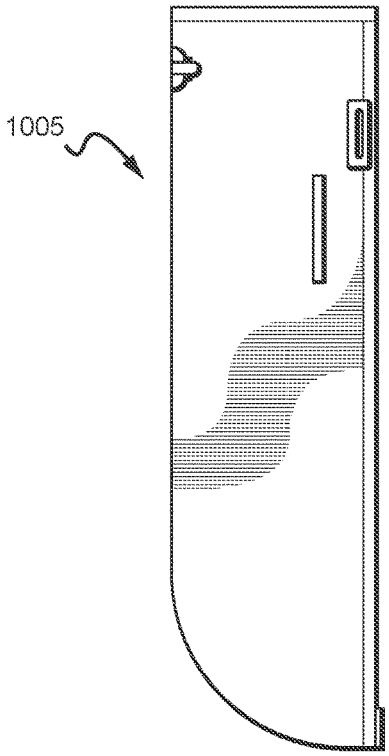
FIG. 13*c* shows a side view of the face of FIG. 13*a*.
Figure 13B:
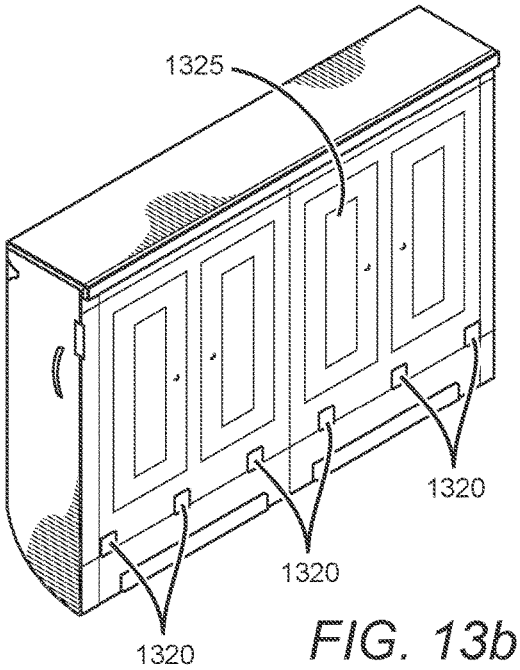
FIG. 13*b* shows a perspective view of the outside of the face of FIG. 13*a*.

FIG. 13*b* shows a perspective view of the outside of face 1005. The outside of face 1005 is decorated with one or more shapes, patterns, and/or textures 1325 so that it resembles the outside of a piece of furniture. The outside surface of face 1005 also has one or more hinges 1320, which couples face 1005 with base 1050 and enables face 1005 to rotate from a substantially vertical position to a substantially horizontal position. FIG. 13*c* shows a side view of face 1005.

Figure 14A:
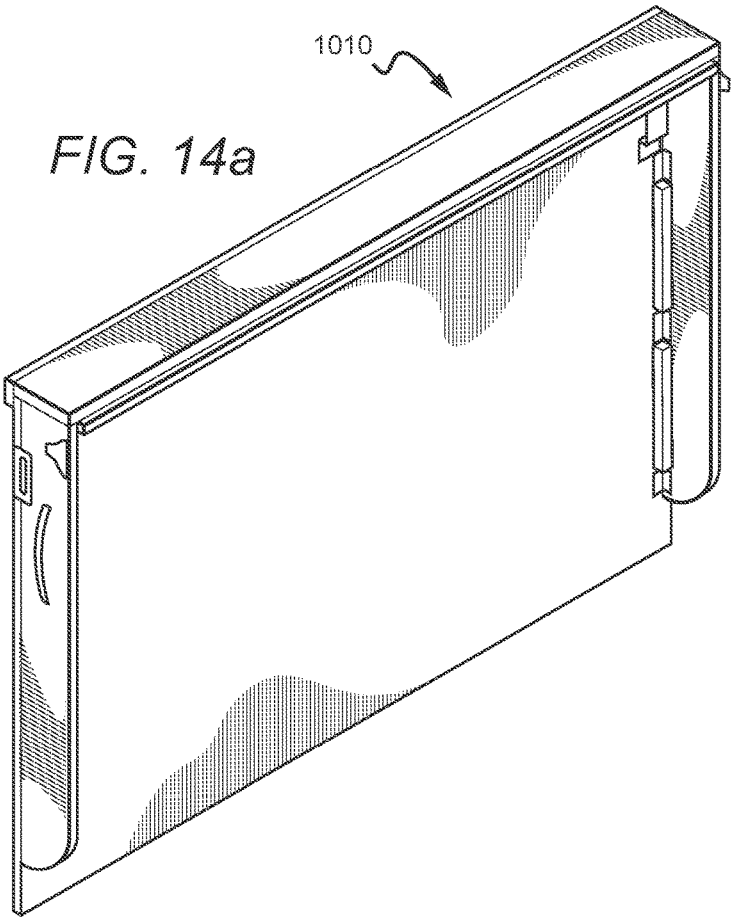
FIG. 14*a* shows a perspective view of the inside of the other face of the cabinet bed of FIG. 10.
Figure 14C:
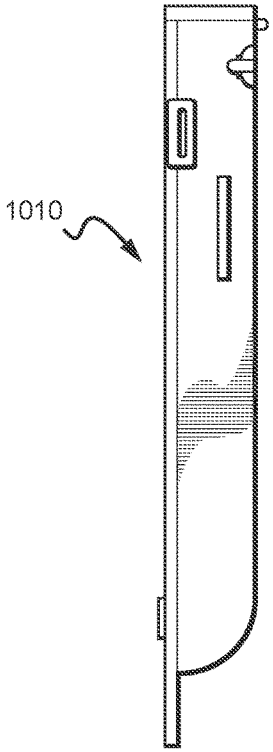
FIG. 14*c* shows a side view of the face of FIG. 14*a*.
Figure 14B:
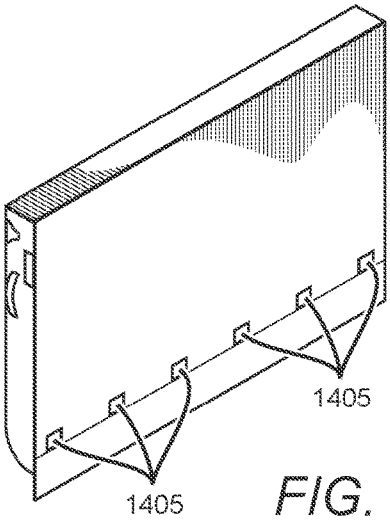
FIG. 14*b* shows a perspective view of the outside of the face of FIG. 14*a*.

FIG. 14*a* shows a perspective view of the inside of face 1010. Face 1010 can serve as the foot board side of cabinet 1000. FIG. 14*b* shows a perspective view of the outside of face 1010. The outside surface of face 1010 has one or more hinges 1405, which couples face 1010 with base 1050 and enables face 1010 to rotate from a substantially vertical position to a substantially horizontal position. FIG. 14*c* shows a side view of face 1010.

FIGS. 15*a* and 15*b* show front and back perspective views of base 1050, respectively. Front surface 1510 is designed to resemble a piece of furniture and, in this case, pair of cabinet drawers. The bottom panel of base 1050 is coupled to the four side panels of base 1050 via brackets 1505. The side panels are secured to adjacent side panels via brackets 1515. (Similar brackets are used to couple the rails, head board, and foot board of face 1005 and face 1010 to their main panels). The inside surface of the two major side panels of base 1020 each have a plurality of hinges 1520 for hingeably coupling face 1005 and face 1010 thereto. Hinges 1520 allow face 1005 and face 1010 to rotate from a substantially vertical position to a substantially horizontal position.

Figure 16:
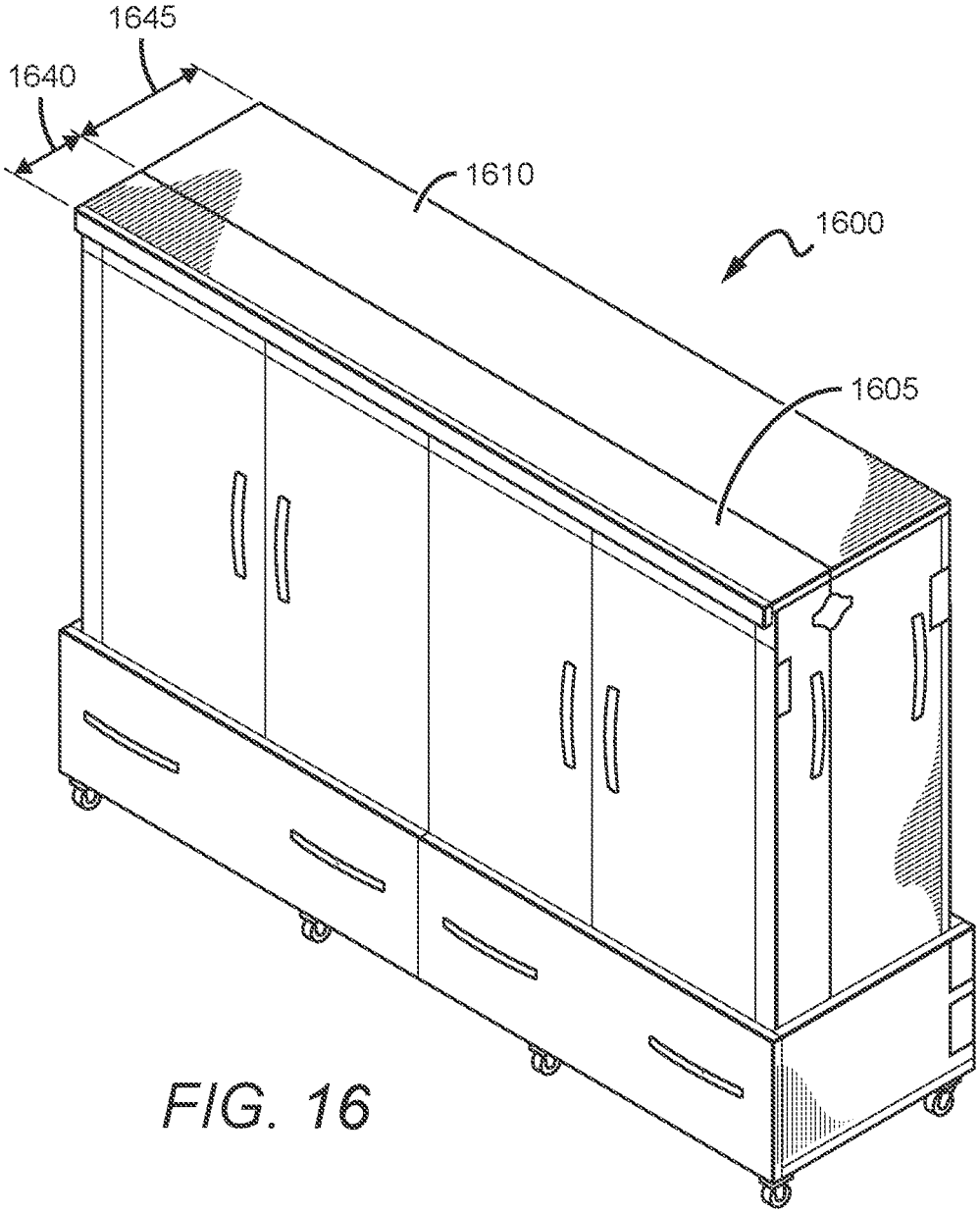
FIG. 16 shows a perspective view of one embodiment of a foldout cabinet bed.
Figure 20A:
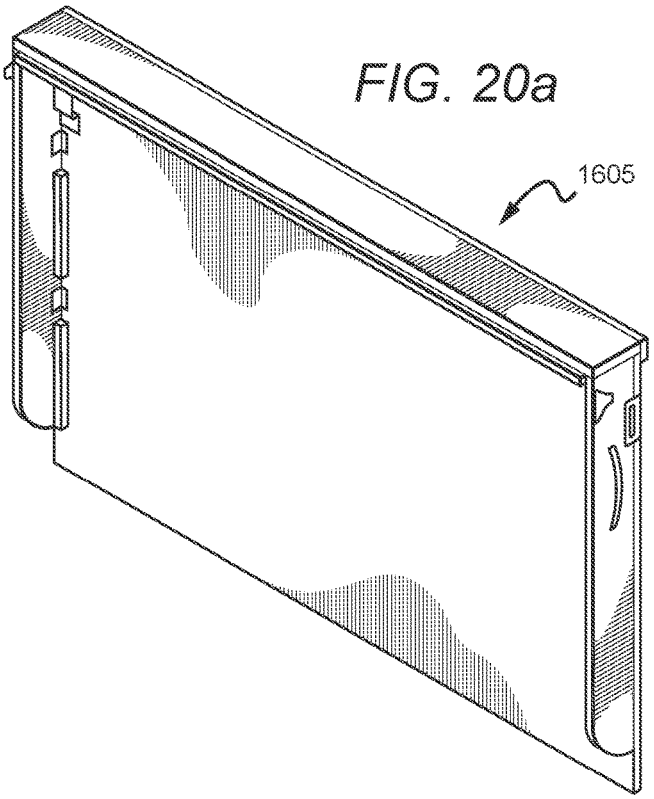
FIG. 20*a* shows a perspective view of the inside of the other face of the cabinet bed of FIG. 16.
Figure 20C:
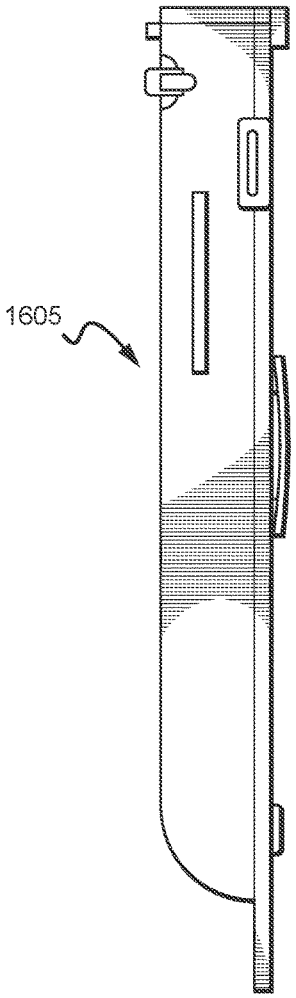
FIG. 20*c* shows a side view of the face of FIG. 20*a*.
Figure 20B:
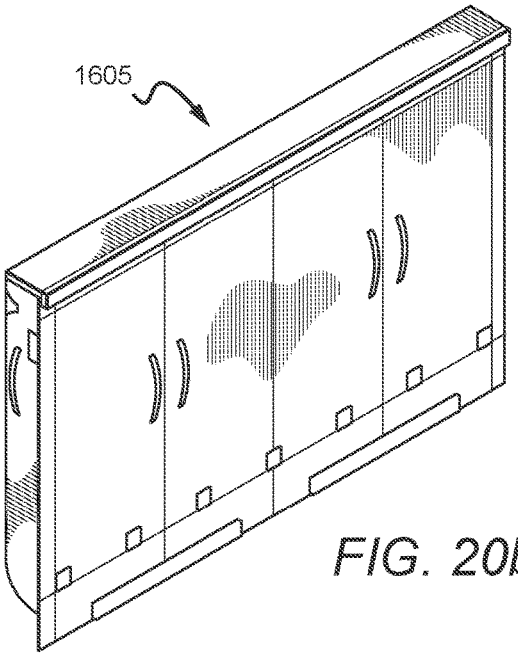
FIG. 20*b* shows a perspective view of the outside of the face of FIG. 20*a*.
Figure 21A:
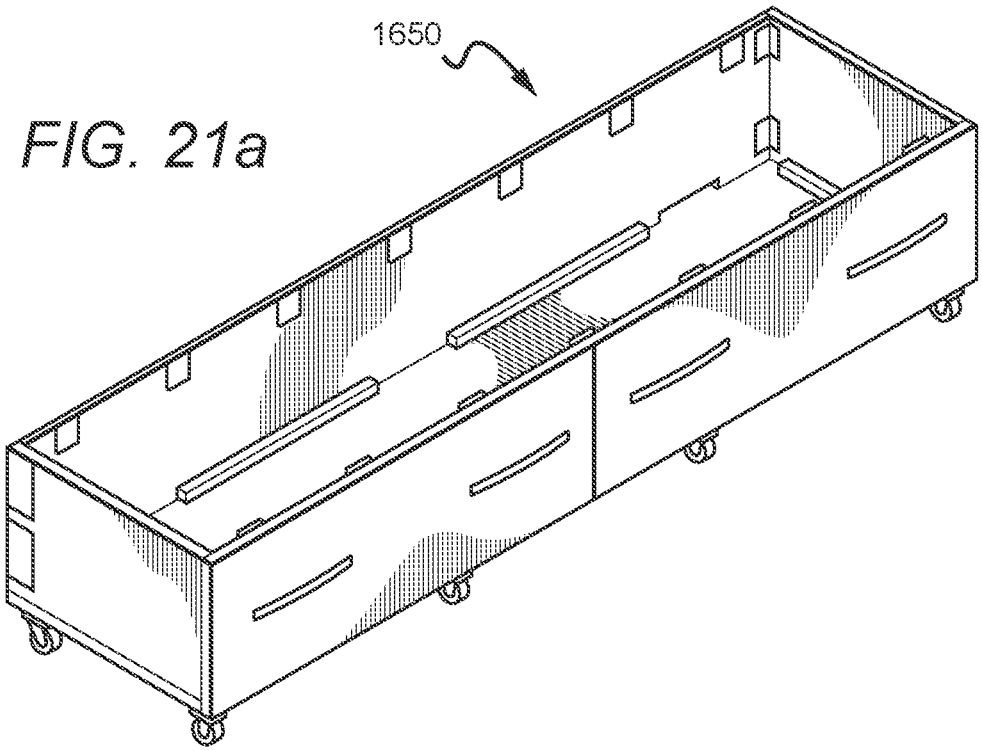
FIG. 21*a* shows a front perspective view of the base of the cabinet bed of FIG. 16.
Figure 21B:
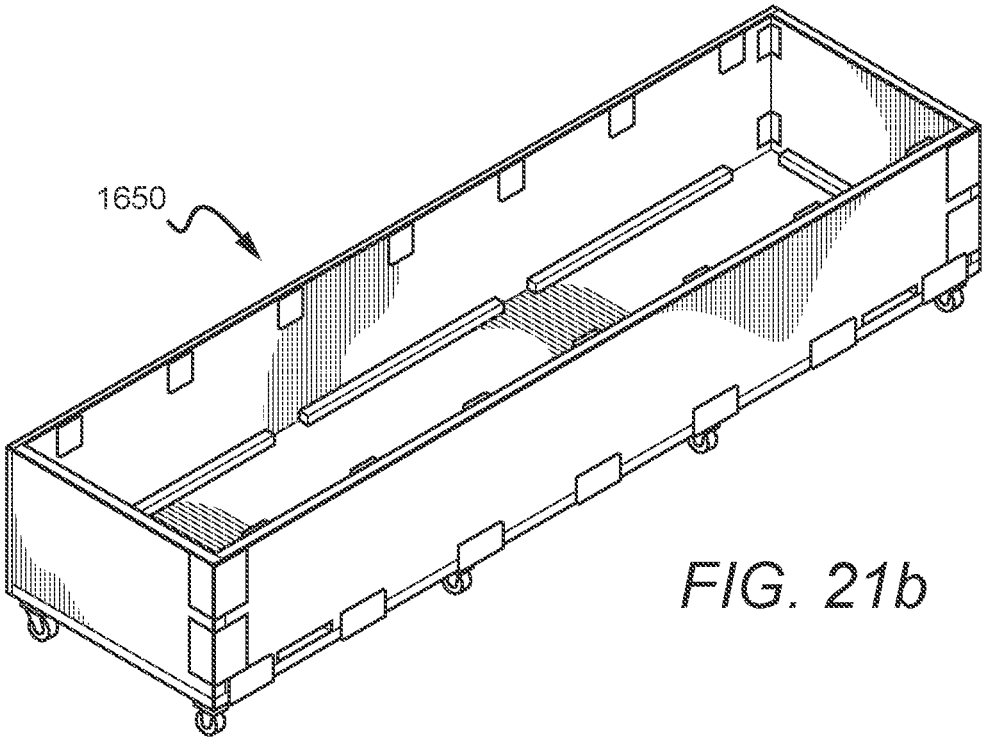
FIG. 21*b* shows a back perspective view of the base of the cabinet bed of FIG. 16.

FIGS. 16 to 21 show various views of another embodiment of a foldout cabinet bed 1600. FIG. 16 shows a perspective view of a foldout cabinet bed 1600. FIG. 17*a* shows a side view of cabinet bed 1600 in a folded configuration. FIG. 17*b* shows a side of cabinet bed 1600 in an open configuration. FIG. 18*a* shows a perspective view of cabinet bed 1600 in a partially open configuration. FIG. 18*b* shows a perspective view of cabinet bed 1600 in an open configuration. FIG. 18*c* shows a close-up view of an insertable leg with rubber padding 1665. FIG. 19*a* shows a perspective view of the inside of face 1615 of cabinet bed 1600. FIG. 19*b* shows a perspective view of the outside of face 1615. FIG. 19*c* shows a side view of face 1615. FIG. 20*a* shows a perspective view of the inside of face 1605 of the cabinet bed 1600. FIG. 20*b* shows a perspective view of the outside of face 1605. FIG. 20*c* shows a side view of face 1605. FIG. 21*a* shows a front perspective view of base 1650 of cabinet bed 1600. FIG. 21*b* shows a back perspective view of base 1650. Like cabinet bed 1000, cabinet bed 1600 also has two asymmetrical faces, namely, front face 1605 and rear face 1610. However, unlike cabinet bed 1000, the front face 1605 has a dimension 1640 that is smaller than dimension 1645 of rear face 1610. When cabinet bed 1600 is transitioned to an open configuration, as shown in FIG. 17, rear face 1610 serves as a head board side while front face 1605 serves as a foot board side and allows a user to comfortably sit down on an edge of mattress 1160. Cabinet bed 1600 is also different from cabinet bed 1000 in that the front surface of front face 1605 resembles a different type of cabinetry. The other features of cabinet bed 1600 are substantially similar to cabinet bed 1000 and will not be described in detail.

Thus, specific assemblies and methods of use for a foldout cabinet bed have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A foldout bed transitionable between an open configuration and a folded configuration, the bed comprising: a cabinet having first and second faces and a base having an interior space; wherein the first and second faces are rotatably coupled with the base such that an end of each of the first and second faces occupies a portion of the interior space when the cabinet is in the folded configuration; wherein the first face has a first rail and the second face has a second rail; wherein the first rail and the second rail are asymmetrical; wherein an end of the second rail extends farther into the interior space than an end of the first rail a foldable mattress having a head end and a foot end; and a retainer disposed to releasably hold both head and foot ends of the mattress to the first face when the first face is disposed in both the open configuration and the folded configuration.

2. The bed of claim 1, wherein the head end is separable from the foot end.

3. The bed of claim 1, wherein the mattress folds between the head end and the foot end in the folded configuration.

4. The bed of claim 1, wherein the mattress is one of an inner-spring mattress and a foam mattress.

5. The bed of claim 2, wherein the mattress has a foldable middle portion that couples the head end with the foot end, the foldable middle portion being sized and dimensioned to fit within the interior space of the base when the mattress is in a folded configuration.

6. The bed of claim 1, further comprising a safety catch that releasably maintains at least one of the faces in a substantially vertical position when the foldout bed is being transitioned from the folded configuration to the open configuration.

7. The bed of claim 1, further comprising at least two wheels coupled with the base.

8. The bed of claim 1, further comprising a removable leg that is removably coupled with one of the first face and the second face.

9. The bed of claim 1, wherein the first face includes a head board and the second face includes a foot board, and wherein the head board and the foot board collectively form a top of the foldout bed when the foldout bed is in the folded configuration.

10. A foldout cabinet bed, the cabinet bed being transitionable between an open configuration and a folded configuration, comprising: a base having an interior space; a first face rotatably coupled with the base and having a first ran; a second face rotatably coupled with the base and having a second rail; wherein, in the folded configuration, an end of each of the first and second faces occupies a portion of the interior space, and the end of the second rail extends farther into the interior space than the end of the first rail; wherein the first rail has a depth and a length that are less than a depth and a length of the second rail; and wherein, in the folded configuration, the first rail depth and the second rail depth are sized and dimensioned to provide a complete side enclosure.

11. The foldout cabinet bed of claim 10, wherein the interior space of the base is sized and dimensioned to simultaneously receive a first end and a second end of a mattress.

12. The foldout cabinet bed of claim 11, wherein the mattress has a thickness that is greater than the depth of the first rail.

13. The foldout cabinet bed of claim 11, wherein the depth of the first rail is less than a thickness of the mattress.

14. The foldout cabinet bed of claim 13, wherein first rail has a depth that is less than a compressed thickness of the mattress.

15. The foldout cabinet bed of claim 10, wherein the first rail is at least approximately 20 inches (approximately 48 centimeters) in length.

16. The foldout cabinet bed of claim 10, wherein the first rail and second rail each have a constant depth.

17. The foldout cabinet bed of claim 10, wherein the first rail and second rail each have a varied depth.

18. The foldout cabinet bed of claim 17, wherein the first rail and second rail each have a length that is shorter than a length of a third rail and fourth rail, respectively.

19. A foldout cabinet bed, the cabinet bed being transitionable between an open configuration and a folded configuration, comprising: a base having an interior space; a first face rotatably coupled with the base and having a First rail and a second rail; a second face rotatably coupled with the base and having a third rail and a fourth rail; wherein the first rail, second rail, third rail, and fourth rail each have a length and a height; wherein the height of the first rail and the third rail are sized and dimensioned to provide a complete side enclosure when in the folded configuration; wherein the height of the second rail and fourth rail are sized and dimensioned to provide a complete side enclosure when in the folded configuration; wherein the length of the first rail and second rail are longer than the length of the third rail and fourth rail, respectively; wherein ends of the first and second rail extends farther into the interior space than ends of the third and fourth rail.

20. The foldout cabinet bed of claim 19, wherein the height of the first rail is greater than the height of the third rail.

21. The foldout cabinet bed of claim 20, wherein the height of the second rail is greater than the height of the fourth rail.

* * * * *